US006308644B1

(12) United States Patent
Diaz

(10) Patent No.: US 6,308,644 B1
(45) **Date of Patent: *Oct. 30, 2001**

(54) FAIL-SAFE ACCESS CONTROL CHAMBER SECURITY SYSTEM

(76) Inventor: William Diaz, P.O. Box 1149, Trujillo Alto, PR (US) 00977

( * ) Notice: Subject to any disclaimer, the term of this patent is extended or adjusted under 35 U.S.C. 154(b) by 0 days.

This patent is subject to a terminal disclaimer.

(21) Appl. No.: 09/441,917

(22) Filed: Nov. 17, 1999

Related U.S. Application Data

(63) Continuation of application No. 08/987,187, filed on Dec. 8, 1997, now abandoned, which is a continuation-in-part of application No. 08/718,023, filed on Sep. 23, 1996, now Pat. No. 5,694,867, which is a continuation of application No. 08/255,488, filed on Jun. 8, 1994, now abandoned.

(51) Int. Cl.[7] ..... E05G 5/02

(52) U.S. Cl. ..... 109/6; 49/68; 109/7; 109/68

(58) Field of Search ..... 109/2–8, 12, 9, 109/11, 13–18, 67, 68; 49/25, 68, 263, 268, 269, 31

(56) References Cited

U.S. PATENT DOCUMENTS

| | | | | |
|---|---|---|---|---|
| 4,060,039 | * | 11/1977 | Lagarrigue | 109/3 |
| 4,308,803 | * | 1/1982 | Pretini | 109/3 |
| 4,461,221 | * | 7/1984 | Schandle et al. | 109/6 |
| 4,481,887 | * | 11/1984 | Urbano | 109/6 X |
| 4,586,441 | * | 5/1986 | Zekich | 109/8 |
| 4,656,954 | * | 4/1987 | Tonali | 109/6 |
| 4,741,275 | * | 5/1988 | Lewiner | 109/7 |
| 4,871,204 | * | 10/1989 | Cook et al. | 70/276 X |
| 5,195,448 | * | 3/1993 | Sims | 109/6 |
| 5,311,166 | * | 5/1994 | Frye | 109/6 X |
| 5,694,867 | * | 12/1997 | Diaz-Lopez | 109/6 |
| 5,992,094 | * | 11/1999 | Diaz | 109/6 X |

FOREIGN PATENT DOCUMENTS

| | | | | |
|---|---|---|---|---|
| 268924 | * | 6/1988 | (EP) | 109/3 |

* cited by examiner

*Primary Examiner*—Lloyd A. Gall
(74) *Attorney, Agent, or Firm*—Nils H. Ljungman & Associates

(57) ABSTRACT

An access control vestibule having first and second locking single doors, an access control chamber formed between the two doors, magnetic locks for each of the doors, a metal detector located between the doors to detect for a weapon, the doors are manually operable and swing towards the outside of the chamber, the frame of the vestibule is rectangular and formed of a metal material, the door frames being formed of a metal material, transparent ballistic resistant panels are mounted in the side walls of the chamber and the door frames, ultrasonic sensors are positioned above the first and second halves of the chamber to detect for the presence of more than one person within the chamber or for the presence of an object such as a weapon on the floor of the chamber, an ultrasonic sensor located above the metal detector, a touch-sensitive pad located on the inside of the exit door of the chamber, a control device to prevent both doors from being opened at the same time and to prevent the second or exit door from being unlocked when the metal detector detects a metal object or the sensors detect the presence of more than one person or an object on the floor.

14 Claims, 35 Drawing Sheets

FAIL-SAFE ACCESS CONTROL CHAMBER SECURITY SYSTEM

RELATED APPLICATIONS.

This application is a continuation of U.S. application Ser. No. 08/987,187, filed on Dec. 8, 1997, now abandoned, which is a continuation-in-part of U.S. application Ser. No. 08/718,023, filed on Sep. 23, 1996, now an issued U.S. Pat. No. 5,694,867, which is a continuation of U.S. application Ser. No. 08/255,488, filed on Jun. 8, 1994, now abandoned.

FIELD OF THE INVENTION

This invention relates to security access systems for banks or the like which satisfy fire department regulations, handicapped regulations, and which in also meets the needs of the bank for reasonably rapid access and the prevention of robberies. The system makes use of multiple security doors which lock to prevent more than one door from opening at a time, and to prevent the inner-most door from opening when a weapon such as a gun is detected by a metal detector.

BACKGROUND OF THE INVENTION

Several types of access control vestibules are known, but do not meet the requirements for use with banks within the U.S. because they do not provide the minimum access time required to be effective in a bank, they do not provide adequate security to keep out weapons, do not present an adequate appearance acceptable by a bank, are expensive to maintain and operate, are expensive and labor intensive to install, and are not adequately secure. Some common access control security systems are suggested in U.S. Pat. No. 5, 195,448, to Sims, U.S. Pat. No. 4,656,954 to Tonali, and U.S. Pat. No. 4,481,887 to Urbano. These and other common access control chamber systems have significant problems which allow criminals who plan around the system to enter the secured building with a weapon. The known systems are either too costly to make and operate, do not provide the minimum access rate for banks to use, do not operate effectively to keep out persons carrying weapons, or do not have a good appearance.

In one example of a method a criminal could use to evade a common access control chamber system, a would -be bank robber can open the outer entry door and throw a weapon between the metal detector panels without activating the unit, proceed to the second entry door, pick up the weapon and enter the bank. Another means of evading a common access control chamber system uses two bank robbers who enter the outer entry door together. The first robber, who has no weapon, then proceeds to the second entry door while the second robber, who has a hidden weapon, straddles the entryway putting his feet on the metal framing, waits for the first robber to open the second entry door, and then both enter the bank. In yet another method of evading a common access control chamber system, a would-be bank robber would proceed inside the entry chamber, activate the metal detector, drop his weapon on the floor, exit the chamber through first entry door, wait for operator to reset the system, and then re-enter, pick up his weapon and enter the bank. Finally, a common access control chamber system could be evaded if while a customer was exiting from a chamber, an armed robber entered the bank through the exit outer door chamber and leaves a weapon for a second robber who is unarmed standing by the inner exit door. The second robber would then open the inner exit door and pick up the weapon. These and other methods of evading common access control chamber security systems render common access control chamber systems partially effective.

Protective door systems of the type which provides some degree of protection and security for banks and similar office environments are well known in the art. One well known device of this type (U.S. Pat. No. 4,060,039 to Lagarrigue) shows a security system having embodiments with a circular or a rectangular shape, the rectangular shaped embodiment having a side-by-side entrance and exit chamber, each with an entrance door into the chamber and an exit door out of the chamber. A control system causes the second door to lock when a weapon carried by a person is detected inside the entrance chamber, preventing the person carrying the weapon from entering the bank. If a weapon is not detected, the second door is unlocked only when the first door of the entrance chamber has been closed and locked. This prevents a person inside the entrance chamber from holding the second door open while another person who may have a weapon enters the entrance chamber. The first door cannot be opened when the second door is open or a person is on a contact pad on the floor of the entrance chamber. One big disadvantage of the Lagarrigue access system is that the walls are made of concrete and thus a bank personnel cannot observe a person passing through the vestibule. A person in a wheel chair or a police or security officer carrying a weapon could not be observed. Also, the concrete walls do not provide a good appearance to match the front of the bank.

The metal detector in the Lagarrigue patent is only for detecting Ferro-magnetic metals such as steel, and operates on measuring changes in a static magnetic field (also called Continuous wave technology), not changes in high frequency electromagnetic fields. The metal detector in Lagarrigue also includes several magnetic field sources (such as ferrite magnets) arranged on each of the two side walls of the chamber and fills the area to be crossed by a person with magnetic fields. A series of large induction loops are adjoined to the magnetic field sources. An electronic device averages or adds the induction voltages being generated in the induction loops of the area crossed by the person. As a result, the reading obtained is practically independent of the location where the weapon is taken through the area.

Another disadvantage of the Lagarrigue system is that the concrete walls must be poured at the assembly site, and must make use of molds to form the walls. Concrete construction is a very timely and costly construction method, and banks do not want to create a construction site at their front door.

Another disadvantage of the Lagarrigue system is the use of double doors. Banks want a system with a single door as opposed to double doors used in the Lagarrigue patent. Double doors require twice the number of locks, making the system more expensive, and the double doors provide a space or gap between them in which an intruder can insert a tool to pry open the doors, making the system less secure.

Another disadvantage of the Lagarrigue system is that the metal is—from a security standpoint—designed to detect "Ferro-magnetic metals" only, which in today's world is impractical, considering the wide array of weapons made from exotic, non-Ferro-magnetic materials such as stainless steel, zinc or aluminum and even plastics or ceramics.

Another disadvantage with the continuous wave based metal detectors of the Lagarrigue patent is that the detectors have high false alarm rates caused by poor electrical interference. The amount of electrical instrumentation used in today's environment is much more than at the time of the Lagarrigue invention. If the unit false alarms often, it will eventually be turned off or ignored by the security personnel, thus defeating its purpose.

Another disadvantage with the metal detector of the Lagarrigue invention is that, because the electronic device uses one series of loops to pick up the magnetic field generated by metals, the system cannot distinguish between a weapon and several pieces of metals carried by a person on several parts of the body, such as the keys, coins, metal watches, jewelry and other small items of metal carried by the person. Thus, the metal detector would indicate the presence of a weapon when no such weapon is present.

Another well known device of this type (U.S. Pat. No. 4,481,887 to Urbano) shows a security door and system of installation having bullet-proof walls and doors, the system being constructed in modular form for on-site assembly, the framework is made of steel or heavy aluminum, the vestibule (chamber) is rectangular or box shaped, the doors open automatically by photo cells, green and red lights indicating whether to wait or pass through the system, an automatic timing device is provided and operates after a person has entered the vestibule through the first door a predetermined time period to open the second door and allow the person to leave the vestibule and enter the building, overhead ventilators, the side walls and doors are made of transparent bulletproof glass or plastic so that a person entering and leaving may be observed by bank personnel, and an over-riding door lock system with a manually operated switch can be used whereby when a bank robber is within the exit chamber all the doors are locked to trap the robber therein. The Urbano system also discloses that the over-riding door lock switch can be operated remotely by a hand-held remote control unit, and briefly suggests that a weapon detector may be integrated into the operating circuit to lock the doors. The Urbano patent does not provide any teaching as to how the weapon detector can be integrated with the system, such as where the detector can be placed.

One disadvantage of the Urbano system is that the metal frame of the doors open into the access chamber and thus will interfere with a metal detector and produce false alarms if the metal detector is located inside the chamber. The metal detector must be located inside the access chamber in order that only one person can enter through at a time.

Another disadvantage of the Urbano system is the use of automatically opening doors. Banks want a system with manually operated doors as opposed to automatically operated doors. Automatic doors are more costly to maintain and operate by the bank, since repairs would require an electrician, and an electric motor needed to power the automatic doors would produce undesired magnetic fields that could interfere with the operation of the metal detector.

Another disadvantage with the Urbano system is the use of double doors as discussed above with respect to the Lagarrigue system, whereby a space or gap is left between the doors that can be used to pry open the doors, and the doors require twice the number of locks.

Another disadvantage with the Urbano system is that the sides of the security chamber are formed of a single piece of bullet proof glass extending from the entrance end to the exit end of the chamber. This results in the requirement to use an extremely large piece of the bullet proof glass, which is extremely heavy and costly. When shipping and assembling the modular sections, the heavy piece of glass is harder to install than would two or more pieces. Also, if the glass was to break due to a fired bullet, the whole side section would require replacing instead of a smaller section.

Another well known device of this type (European Patent application 268,924-A to Maillot) shows an automatic access control airlock with a weapon detector having an eddy current movement detector, contact carpet presence detectors in the front and back of the passageway, locking and unlocking of the doors are controlled automatically by the presence detectors, the door frames are made of a non-metallic material (fiberglass reinforced plastic), the first door opens toward the inside of the access chamber, the first and second door hinges are on the outside and are recessed, and the closing locking of both doors are set into the box frame. The non-metallic (plastic) door frames are used for the purpose of reducing interference of the metal detector when the door opens toward the detector. The metal detector is located toward the first or entrance door.

One disadvantage of the European system is that the door frames are made of plastic. If the main frame is to be made of a metal such as aluminum, the cost and complexity of making the repairs is greatly increased because of the need of different materials and processes of making them. Also, if a repair of the door frame is necessary—such as when a bullet hole in the door must be repaired—the entire door would have to be replaced, resulting in the entire unit being shut down until a replacement door can be delivered from the manufacturer. Also, the plastic used in the door would tend to dry out over time and crack. Further, screws are used to secure parts to the plastic door frame. The plastic around the screws tend to fracture over time, and thus, the screws tend to come lose. Also, the first door opens toward the inside of the chamber which requires that the unit be longer than would a unit in which the door opens toward the outside.

Another well known device of this type (U.S. Pat. No. 4,741,275 to Lewinder et al.) shows a device for controlling access of the security chamber which can unlock all doors in case of a fire so as to free the passage to the exit from the bank. Also shown is a wireless remote control unit which is used to change the operating mode of the security chamber.

A device for manually controlling access to a security chamber such as that described in U.S. Pat. No. 4,741,275 to Lewinder et al. might prevent robbers from evading or "tricking" a completely electronically controlled system. However, the Lewinder device would be completely ineffective if the human operator was removed by force or did not detect the "trick."

Another well known device of this type (U.S. Pat. No. 5,311,166 to Frye) shows a security vestibule having a security access system which preferably operates on a low voltage independent power source, and a high voltage DC power source is used to power a switch. This patent is silent as to what parts of the system use the low voltage power source and the high voltage power source.

One disadvantage of the systems in the prior art devices is that the doors are made from a metal, and can cause the metal detector to give false readings. A door that opens toward the metal detector provides a metallic material within the range of the metal detector's magnetic fields. Also, door frames made of a metal create an electrical closed loop near the metal detector. When the door is opened (or moved), a magnetic field is created by the closed metal loop within the door frame which causes interference with the metal detector. This interference can cause the metal detector to false alarm. One well known technique to reduce or eliminate the magnetic effect from a closed electrical loop in the metal door frame is to provide an insulated cut section in the door frame so that an open loop is formed where the closed loop was so that movement of the door frame will not generate a magnetic field. One disadvantage of cutting the metal door frame is that the structural strength of the door frame is thus reduced.

Accordingly, it is desirable to have an access control system that is more effective at detecting weapons and not false alarming. Also, it is desirable to have an access control system that has a good appearance, has low maintenance costs, provides quick access rates for bank customers, is easy and less expensive to install, and is secure. The more effective method would be able to prevent the techniques described above for evading common access control chamber systems, and would meet with Access Control Unit Requirements for Financial Institutions in the United States. These requirements include: must have the ability to identify an armed person and prevent entry; low cost; user friendly; low maintenance; made in the USA; fail safe system; must meet ADA (Americans with Disabilities Act) and NFPA (Fire) Federal requirements; fully automatic control system normally requiring little operator intervention; bullet resistance glass and metal framing; ability to "lock" or to "unlock" all doors simultaneously; modular construction which would permit future relocation; low cost facility renovation to accommodate unit in existing doorways; high flow (4–5 seconds process time per person); manually operated doors; must permit access by only one person at a time; ability to interface with building fire alarm system; ability to interface with local existing security alarm system; ability to discriminate between a weapon and other metals; ability to detect static metal inside the chambers (Weapons left on floor); ability to prevent straddling; user may be allowed to exit the entrance booth if he so desires even thought he may be armed; integrated Close Circuit TV System interfaced with the system; ability to allow a second person to release the entrance door via a wireless button if the metal detector is activated; ability to detect a weapon if the person throws the weapon between the metal detector's panels, closer to the entrance door; and ability to allow an adult with a child to enter and exit.

Accordingly, a principal object of the present invention is to provide a security access system for banks or the like which satisfies fire department regulations, handicapped regulations, and which also meets the needs of the bank for reasonably rapid access and the prevention of robberies.

BRIEF SUMMARY OF THE INVENTION

The access control system of the present invention provides a system having a low cost of manufacture, installation and operation, provides for the quick access rates needed for U.S. banks, provides the effective use of detecting for weapons to prevent a banker robber from entering into the bank or building, and provides a secure access chamber so that a trapped robber cannot injure a person within the bank.

The instant invention overcomes the above disadvantages and shortages of the prior art by providing an access control chamber security system with substantial improvements, such as;

- the access chamber is formed entirely of a metal (such as aluminum) framing and bullet-resistant glass panels in the walls and doors, the chamber uses a single metal detector in the center of the door system or offset away from the entrance door of the entrance chamber and spaced from the doors such that interference from the doors can be reduced or eliminated;
- the two side-by-side units are capable of being split apart due to requirements of the building structure;
- the sides of the access control chamber are formed of two sections with a metal (such as aluminum) framing member separating the two sections;
- the door frames are made of the same metal material as the rest of the access chamber in order to reduce the cost of manufacture by minimizing the types of materials, provide a good appearance when assembled, require less difficulty in assembling the unit or less difficulty in making repairs to the doors;
- a wireless remote control unit so that a second person can control the opening of the second door in the event that the main operator must leave the area in which the main control panel is located;
- a 24 volt dc power source for the metal detector and the magnetic locks for the purpose of preventing electrical shock to a person within the chambers who may be installing or working on the system or from a fired bullet that may short out the electrical system;
- a battery backup at the control panel;
- the metal detector to operate at 24 volts dc in order to prevent noise, surges and peaks in the metal detector circuitry;
- the metal detector to remain on after the assembly has been shut down in order that humidity in the air will not accumulate on the electronics and cause the metal detector to short out and produce false alarms;
- an insulated cut section in the side wall sections and/or in the door frames so that no closed electric loops are formed in the main frame or door frame;
- an ultrasonic sensor located above the metal detector in which the metal detector is enabled when a person walks through the detector; and,
- two ultrasonic sensors above the entrance chamber to detect if more than one person is in one of the chambers or if an object such as a weapon was left on the floor.

For example, a fail-safe access control vestibule may include a first interlocking door for providing passage from a non-secure area into the entrance chamber and a secure area. The entrance chamber may also include a first ultrasonic sensor and a second ultrasonic sensor located between the first and second interlocking doors to determine the location of a person within the entrance chamber, or to determine if more than one person is inside the entrance chamber. The entrance chamber would also have a means for preventing the simultaneous opening of the first and second interlocking doors. An ultrasonic sensor could also be located above the metal detector to activate the detector when the person walks through.

The exit chamber would include a third interlocking door for providing passage from the secure area into the exit chamber to the non-secure area. A third ultrasonic sensor located between the third and fourth interlocking doors would be used to determine the location of a person within the exit chamber. The exit chamber would also have means for preventing the simultaneous opening of the third and fourth interlocking doors. A control panel would preferably be provided to externally control the dual chamber ACU. Finally, a power supply would be connected to and supply power to the ACU.

The objects of the invention are realized in that the access control system utilizes a skeleton frame made of metal such as aluminum, door frames made of the same metal material to reduce the material list, the doors in the chamber of the metal detector swing outward to reduce interference therefrom, a metal detector located in the middle of the access control chamber or far enough away from the entrance door that the movement of the door does not interfere with the operation of the metal detector, a cut section in the door frame and/or the side frame members of the vestibule to eliminate the closed electrical loop effect, a 24 volt DC uninterrupted power supply (UPS) which can be plugged into a typical AC outlet and which uses common 24 volt DC batteries for the UPS source, the system and the metal detector operating under 24 volt DC so that the system can be installed in any part of the world with minimal modification and so that the possibility of electrocution during installation or if a fired bullet was to short out the system, using a wireless remote control box so that a second operator can control the opening of the exit door, keeping power supplied to the metal detector on at all times even after the rest of the system has been shut off after closing of the doors so that water vapor does not condense on the electrical circuits and produce shorts and false alarms, using a plurality of ultrasonic sensors to detect if more than one person is in the entrance chamber or if an object such as a weapon has been left on the floor of the vestibule.

Other objects, features and advantages of the present invention will become apparent from a consideration of the following detailed description, and from the accompanying drawings.

DETAILED DESCRIPTION OF THE PREFERRED EMBODIMENTS

Figure 1:
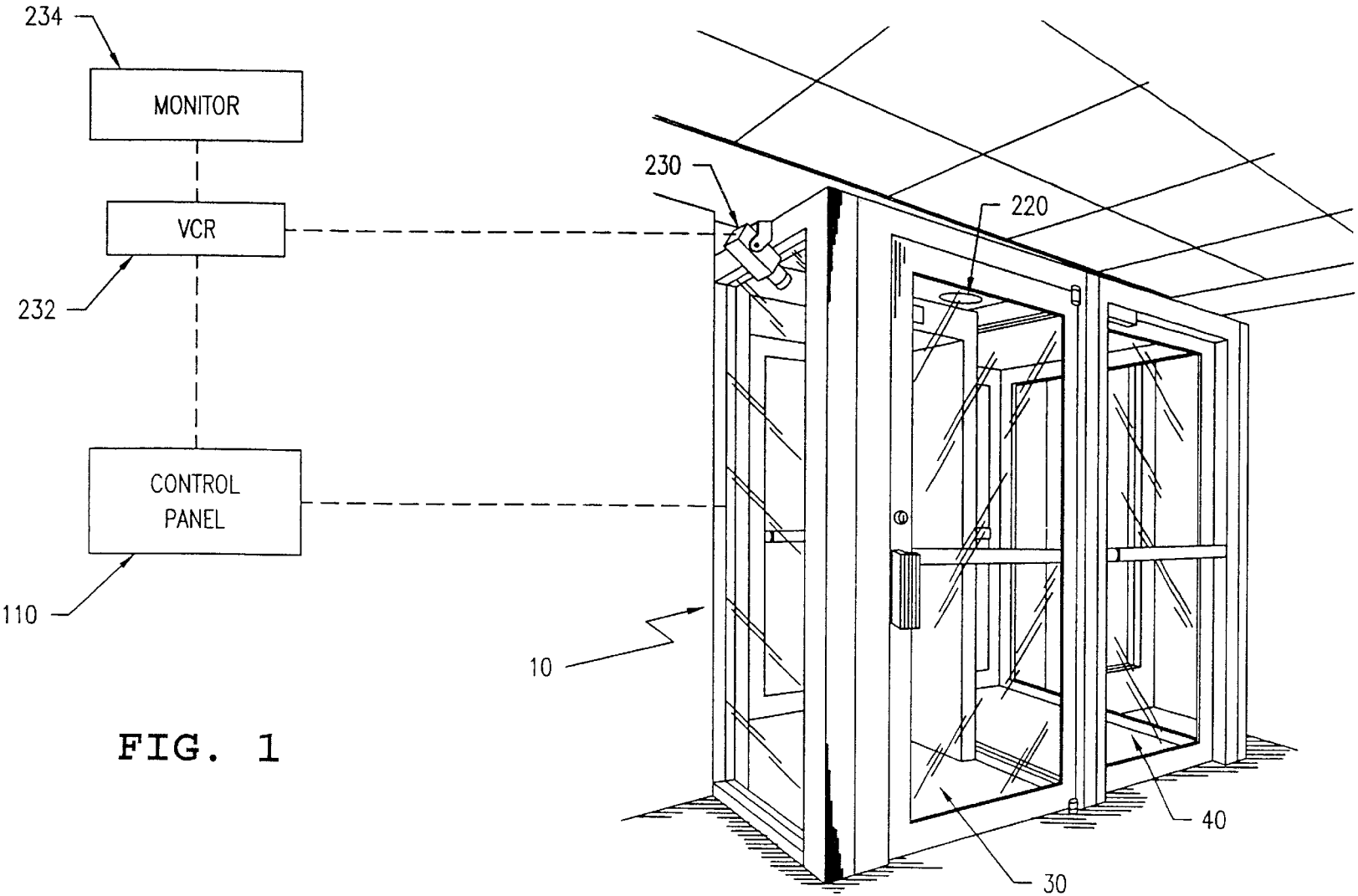
FIG. 1 is a perspective view of an illustrative preferred embodiment of the invention from an interior angle.

The preferred embodiment of the present invention, an access control vestibule, preferably includes an access control unit (ACU) 10 having an entrance chamber 12 which includes a metal detector 60 and an exit chamber 14, a control panel 110, and a power supply 160. The vestibule also preferably includes switching arrangements 180 for remote personnel, such as bank tellers, to provide a control signal to prevent exit from the exit chamber 14.

Figure 2:
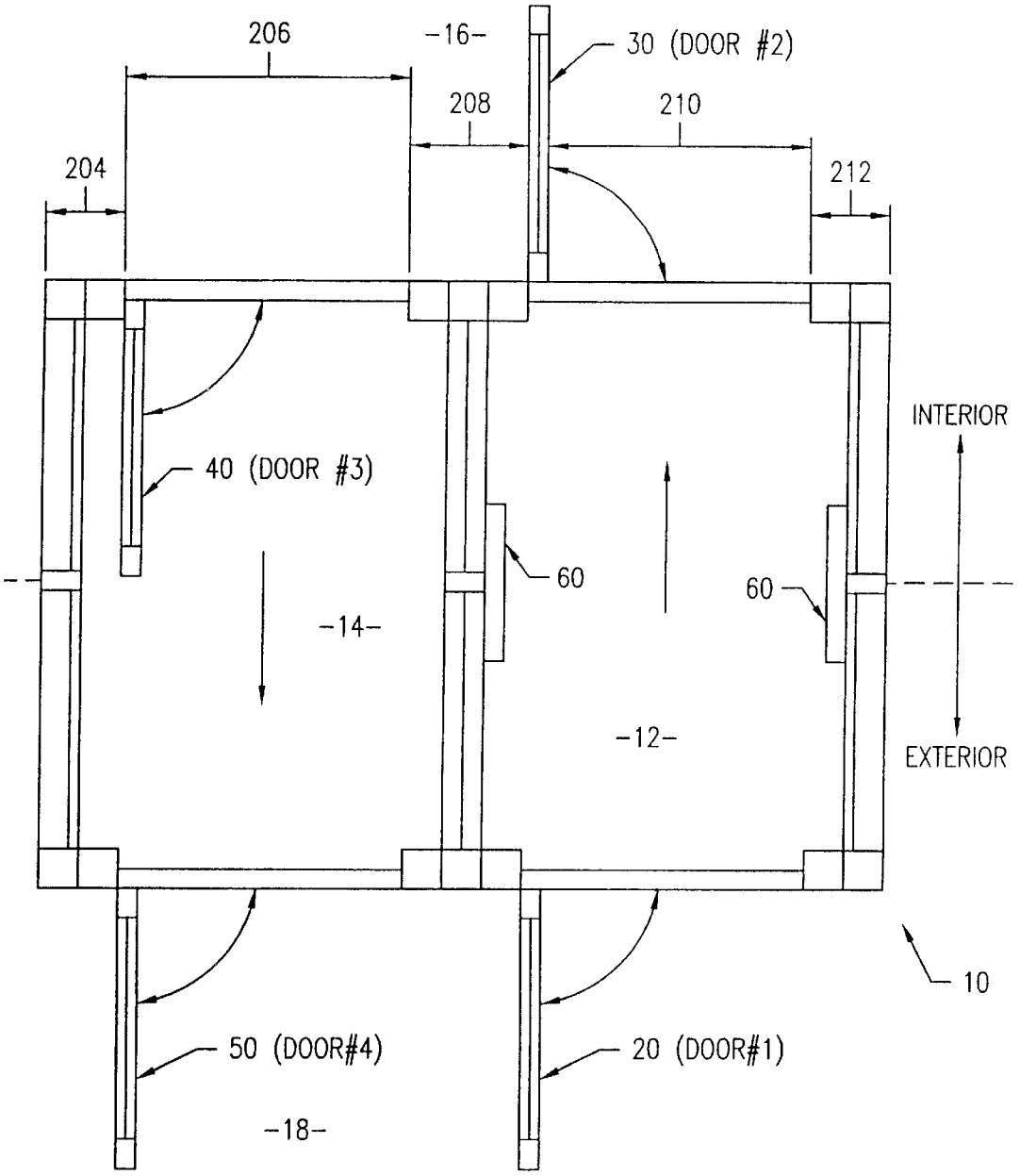
FIG. 2 is an overhead schematic diagram of the preferred embodiment of the access control unit (ACU) including an entrance chamber and an exit chamber.

Referring more particularly to the drawings, FIG. 1 is a depiction of a perspective view of a preferred embodiment of the ACU 10 as viewed from the is interior 16 of the protected or secured area such as inside a bank. FIG. 2 shows an overhead schematic diagram of the ACU 10. The ACU 10 includes an entrance passage or chamber 12 which allows controlled departure from the exterior 18 of a structure to the interior 16 of the structure. The entrance chamber is divided up into a first half 90 and a second half 92. A metal detector 60 separates the two halves. The entrance chamber 12 preferably includes a first door 20 and a second door. The metal detector is located half-way between the first door 20 and the second door 30. When a shorter vestibule is required—such as when space is a minimum—the metal detector could be located closer to the second door 30. A magnetic lock 54 is located on the top corner of the frame near the first door 20 to provide means to lock the first door 20. A magnetic lock 44 is also located near the second door 30 to provide means to lock the second door 30. Each door 20 and 30 also includes a sensor to determine if the door is opened or closed. The ACU 10 also includes an exit passage or chamber 14 which allows controlled access from the interior 16 to the exterior 18 of a structure. The exit chamber 14 preferably includes a third door 40 and a fourth door 50. The exit chamber 14 is also divided up into a first half 96 and a second half 94. Both doors 40 and 50 also include a magnetic lock and a door closed position sensor. All four doors (20,30,40,50) are single frame doors which are manually operated. By using manually operated doors, the cost of the system is lower, the maintenance is less (since electric motors to power automatically operated doors can burn out and require replacing), electric motors used for automatically operated doors would produce magnetic field interference with the metal detector, and no space is present such as when double doors are used that a person can place a pry bar into the space and force the door open.

Incidentally, in the following specification the outer entry door is referred to both as the No. 1 door, and by reference numeral 20, the inner door is referred to both as to the No. 2 door and as door 30, and the two exit doors are referenced both as the No. 3 and No. 4 doors and by reference numerals 40 and 50, respectively.

Figure 9:
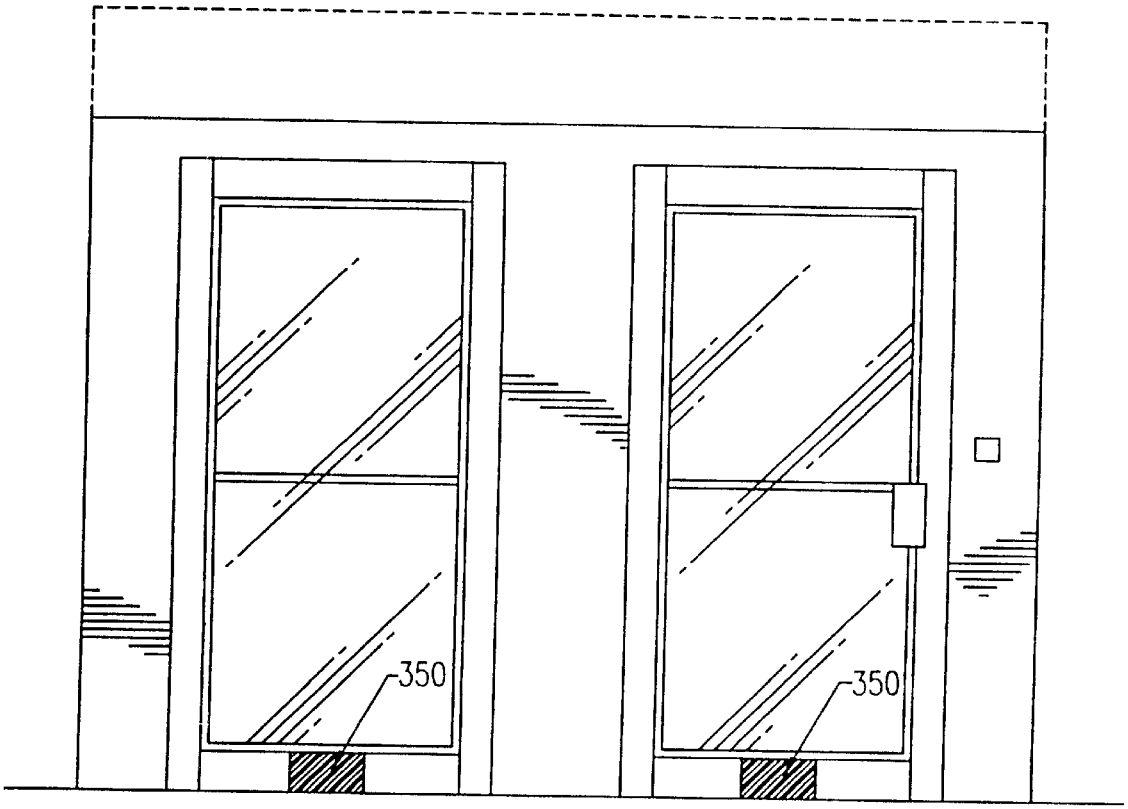
FIG. 9 shows the door frames with insulated cut sections formed therein.
Figure 10:
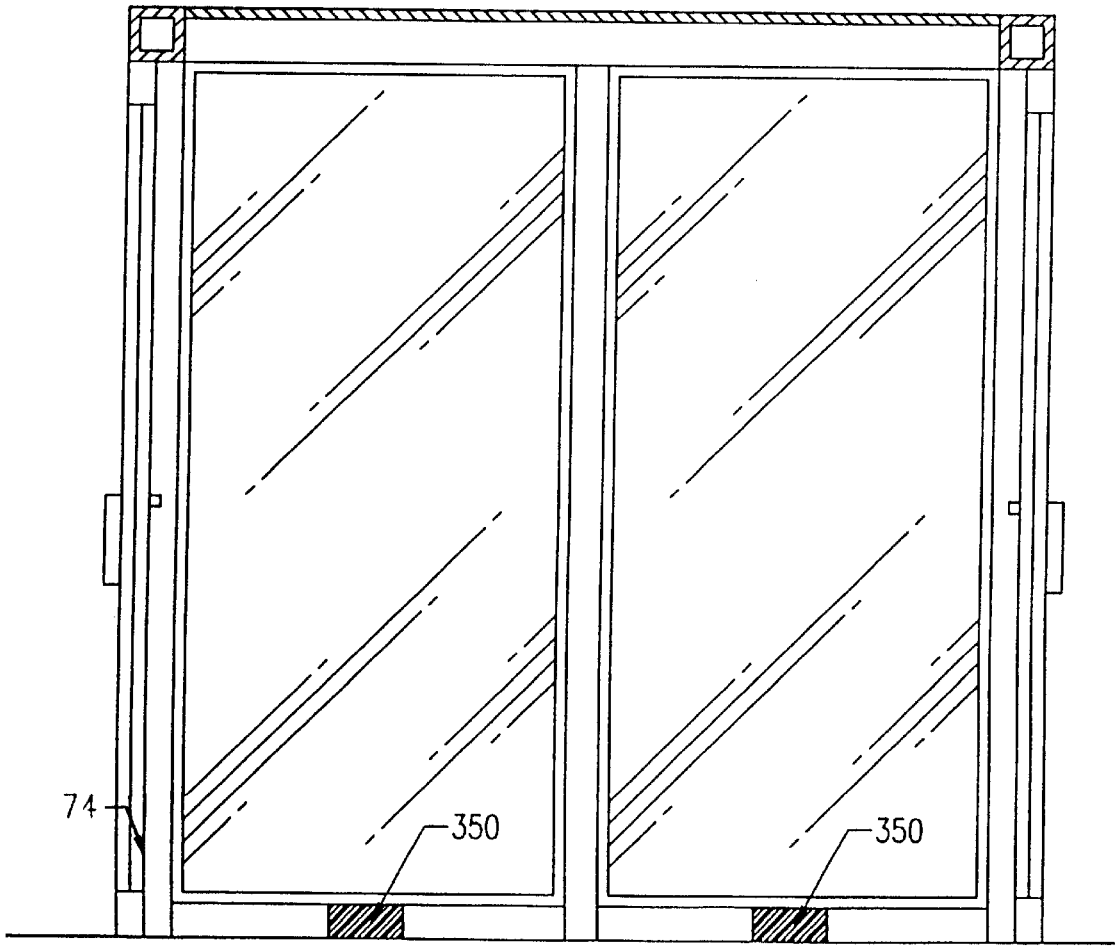
FIG. 10 shows the side frames of the vestibule with insulated cut sections therein
Figure 11:
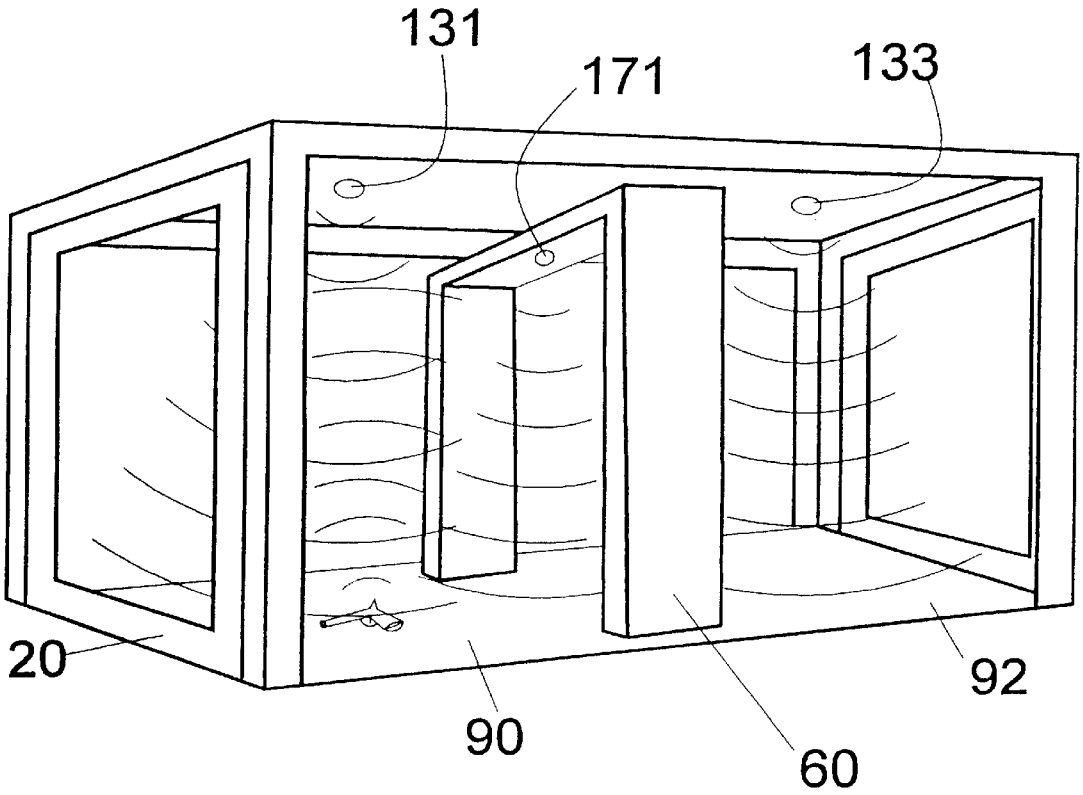
FIG. 11 shows an access chamber of the vestibule having two ultrasonic sensors located above the front section and the rear section of the access chamber, and a third ultrasonic sensor positioned above the metal detector.

FIG. 2 also shows the first door 20 swinging open towards the outside of the entrance chamber 12. The second door 30 also swings towards the outside of the entrance chamber 12. This provides less magnetic interference to the metal detector 60 than would doors swinging inward or towards the magnetic detector 60. In order to reduce the magnetic interference effect of the metal doors 20 and 30, an insulated cut section 350 is placed in the side walls of the vestibule and/or the door frames. See FIGS. 9 and 10 for the insulated cut sections. The cut sections are placed wherever an electrical closed loop can be formed in any frame members. If the entrance chamber is less than a certain length, then the swinging metal doors will interfere with the operation of the metal detector because of the closed electrical loop effect. One way to eliminate this effect is to provide the insulated cut sections in the side walls of the access chamber. Placing the insulated cut sections in the door frames is less desirable because the structural strength of the door frames would be reduced. Since the lower members on the side wall frames are secured to the floor, a cut section in this member can be easily reinforced to maintain structural strength of the access chamber. The entrance chamber 12 can be of such a length that the outwardly swinging doors 20 and 30 would not interfere with the operation of the metal detector 60. In banks where space is minimum, the shorter length access chamber is desirable and therefore the cut sections are needed to improve the performance of the metal detector and thus the access control system.

Another embodiment to eliminate the closed electrical loop effect is to offset the metal detector 60 to the side away from the first door 20 of the entrance chamber 12. The metal detector 60 should be far enough away from the first door 20 so that the closed loop electrical effect is not strong enough to interfere with the operation of the metal detector 60. Since there are many different manufacturers of metal detectors and each one can be effected differently by outside magnetic interference, an accurate distance cannot be established at this time. However, normal experimentation with the metal detector can provide the proper distance in which the magnetic effect from a closed loop door frame would be within executable levels. In a vestibule having a length of 6 feet 6 inches, if the metal detector is placed a little over four feet from the entrance door, the swinging door does not interfere with the magnetic detector and no cut section is needed if the latching speed of the door (the closing speed of the door in the last portion of the closing arc) is slow. A standard door closure device will provide this slow latching speed. When the metal detector is offset towards the second door 30, some means of deactivating the metal detector is needed before the second door is opened, or the second door 30 will also provide magnetic interference to the metal detector 60. A sensor to detect when the second door begins to open will provide this means, or in the preferred embodiment the touch sensitive push bar will be used.

In another embodiment, the access control chamber can use a control system that will activate the metal detector 60 only during periods when interference from the swinging doors 20 and 30 are at a minimum. The first door 20 can be located far enough from the metal detector 60 such that closed electrical loop interference therefrom will not interfere with the operation of the metal detector 60. A person would open the first door 20 and enter the access chamber 12, pass through the metal detector 60, and when the person touches the touch bar on the second door 30 to enter the bank, the control system could disable the metal detector so that closed electrical loop interference from the second door 30 would not interfere with the operation of the metal detector 60. The touch bar—which is described later—is used to unlock the magnetic lock on the second door 30. The access chamber 12 can be made even shorter by using an insulated cut section 350 (see FIG. 10) in the side walls of the entrance chamber, and placing the metal detector 60 as close to the second door 30 as possible while using the control system to disable the metal detector 60 when the touch bar on the second door 30 is touched. The closest that the metal detector 60 can be placed to the second door 30 would be such that when a person is directly under the metal detector 60, his reach would just about touch the second door 30. The metal detector must remain on for a period to allow the person to pass through. In one embodiment, when the person touches the second door to begin opening the door, the metal detector is disabled. If the metal detector 60 was closer to the second door 30, then the second door 30 would begin to open (and create magnetic interference) before the metal detector 60 is deactivated.

Figure 5A:
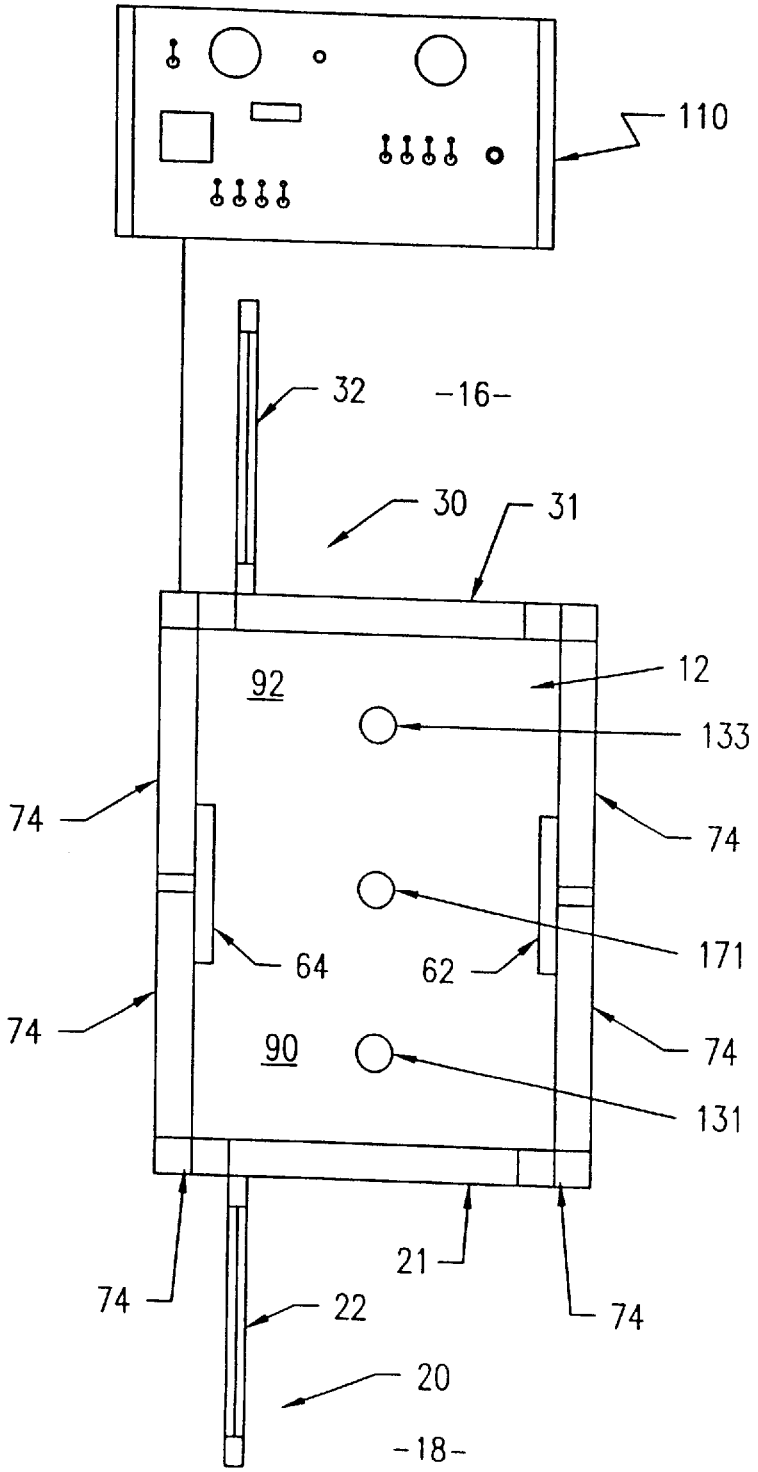
FIG. 5A is a schematic diagram of the entrance chamber interlocking doors system.

FIG. 5A shows the entrance chamber 12 which controls access using the two doors (20 and 30). The doors 20 and 30 are located on either end of the chamber 12 and preferably have electromagnetic locks (24 and 34) and touch sense bars (25 and 35, FIGS. 6C–6D). The exterior No. 1 door 20 is normally in the closed position 21, but may be brought to an opened position 22 by manually pulling exterior handle 26 (FIG. 6C) so that the door opens outward. No. 1 door 20 may also include a push bar 25 (FIG. 6C). The interior No. 2 door 30 is normally in the closed position 31, but may be brought to an opened position 32 by pushing push bar 35 (FIG. 6D) so that the door opens outward into the interior 16 of the secured facility. No. 2 door 30 may also include a handle 36 (FIG. 6D) on the "interior" side of the door which the operator may use to manually open No. 2 door 30 after it has been released by the control panel or other means. Associated with each of the four doors is a magnetic lock located in the top corner of the frame opposite to the side of the hinges on the door. Also located in the frame is a door closed position sensor for each door a touch sense bar 25 for door No. 1, a touch sense bar 35 for door No. 2, a touch sense bar 45 for door No. 3, and a touch sense bar 55 for door No. 4, used to determine if the door is opened or closed.

Within the entrance chamber 12 is a metal detector 60 located approximately half way between the No. 1 door 20 and No. 2 door 30. The entrance chamber 12 also includes a first ultrasonic sensor 131 located above the entrance side 90 to the entrance chamber 12, and a second ultrasonic sensor 133 located above the exit side 92 to the entrance chamber 12 and on the opposite side of the metal detector 60 than the first ultrasonic sensor 131. The ultrasonic sensors are used to detect the presence of a person in the respective half of the entrance chamber 12, and to detect for the presence of an object such as a weapon left on the floor of the entrance chamber 12. An additional ultrasonic sensor 171 located above the metal detector 60 can be used to detect when a person enters through the metal detector. In the embodiment in which the metal detector is not continuously in operation, such as when the detector 60 is disabled so that the swinging doors will not effect the operation of the metal detector, some means to detect the presence of a person passing through the metal detector is needed in order to activate the detector. The ultrasonic sensor 171 located above the metal detector 60 will activate the detector when a person begins passage through the detector. The scan area of the ultrasonic sensor 171 can be large enough to cover an area such that the detector 60 will be activated when the person is about ½ to 1 foot from entering the detector. This way, the detector will be activated when the person is passing through the most effective region of the detector 60.

The swinging of the door causes a magnetic interference with the metal detector. The farther the door is away from the closing position, the less interference is generated. Only the last portion of the closing arc of the door produces enough interference to cause problems with the detector. When the door is opened more than about 1 foot, the door motion does not seem to cause interference problems. It is the last one foot of swinging motion that causes the interference. If a door closure device is used to regulate the speed at which the door is closed, the interference can be reduced or eliminated. Door closures that provide an initial fast closing speed, followed by a slow closing speed in the last foot, would provide the least amount of interference from the door.

Entrance access is controlled by the entrance chamber 12 so that only one person at a time may access the secured facilities or structure. Normally, the outer or exterior No. 1 access door 20 is unlocked until someone enters and stands on the first half 90 of the entrance chamber 12, which triggers the system to lock and secure No. 1 door 20 in the closed position 21 and prevents No. 1 door 20 from being opened from the exterior 18 of the secured environment. The person then proceeds through the metal detector 60 and onto the second half 92 of the entrance chamber 12. If no metal is detected, the person simply opens No. 2 door 30 and enters the interior 16 of facility without any intervention from the operator.

Figure 3:
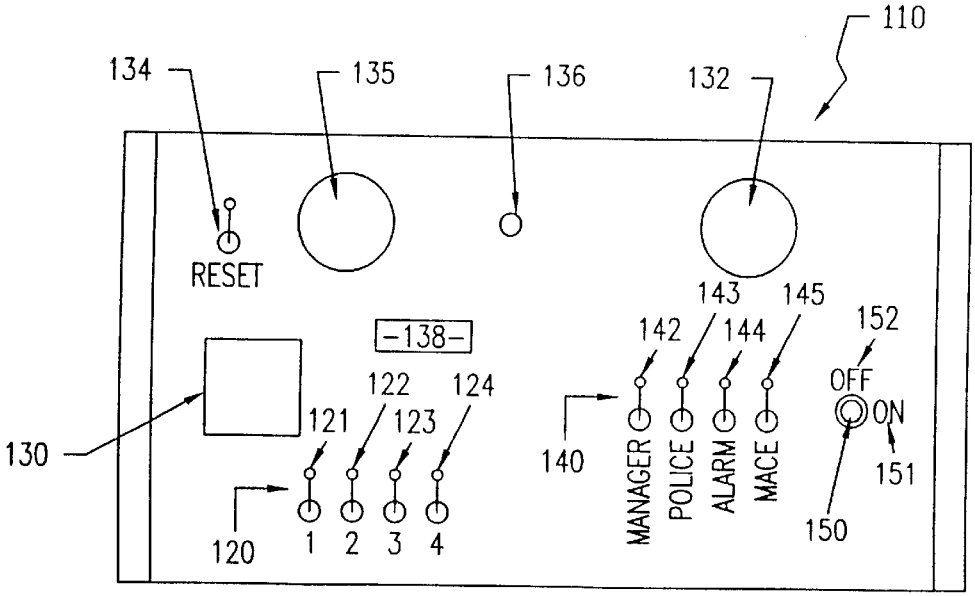
FIG. 3 is a front view of a control panel which may be employed in the access control system.

If metal is detected, the inner No. 2 door 30 is locked and a metal detector alert 135 such as a pulsating audible is sounded or a flashing LED is triggered on the control panel 110 (also see FIG. 3). At this point, there are several options; the person can return to the outer entry door 20 and leave the chamber 12 freely or the operator may push a button 130 (FIG. 3) to release the No 2 door 30. The operator may also decide to toggle the No. 1 control panel door switch 121 "up" which will trap the person in the chamber 12, not allowing access or egress. This scenario may be used when someone is brandishing a weapon and the police are being called.

If two people enter chamber 12 through the No. 1 door 20 and one of them stands on the first half 90 of the entrance chamber 12 and the other stands on the second half 92, the inner entry door 30 will not open. If one of the persons tries to stand off the floor by straddling and putting his feet on the aluminum or other suitable material framing 74, the ultrasonic sensors 131 and 133 will also detect more than one person within the access chamber 12—even if both people stand in the same half of the chamber—and will not allow No. 2 door 30 to open. The ultrasonic sensor can be programmed to detect if more than one person is standing within the range of the sensor. One of the persons must exit the chamber 12 and may return only when the first person exits the entrance chamber 12.

If a person enters through the No. 1 door 20 with a weapon, activates the metal detector 60, and leaves the weapon on the second half 92 of the entrance chamber 12 and walks back out, the second ultrasonic sensor 133 will detect the weapon on the floor of the second half 92 and prevent the No. 1 door 20 from opening until the chamber 12 is inspected and the weapon removed. If the weapon is left on the first half 90 of the chamber 12, the first ultrasonic sensor 131 will detect the weapon and alert the control system so that the second door 30 is not unlocked, and the first door 20 can optionally be locked.

Located inside the vestibule chamber and above each section is an ultrasonic sensor or transceiver of the type marketed by Herian Proffer(USA) of Stillwater, Okla. Model number HE-US Series Ultrasonic transceiver is a low cost, super sensitive, ultrasonic transceiver which can be used to measure position of objects as small as a grain of sand or as large as a brick wall within a distance ranging from 0.2 meters to over 20 meters. Each ultrasonic sensor (see FIG. 12A) operates by omitting a series of sonic bursts (TX) once each 60 micro-seconds (or 15 times per second) and reads the resulting echo (RX). Thus, the ultrasonic sensor will not interfere with the operation of the metal detector, e.g. produce signals that would give false readings by the metal detector. The sensor has a memory in which is stored the signal or echo of the sonic bursts off of an object. Any deviation of the signal or echo from that stored in memory produces an alarm signal from the sensor. The transceiver has 3 dip switch blocks containing four switches (16 levels) each. Block 1 selects sensitivity, block 2 selects inner boundaries of the scanning zone, and block 3 selects the outer boundaries of the scanning zone. The transceiver will transmit a sonic burst of lengths proportional to the outer boundaries selected. Each transceiver has a synchronization pin, and a switch that allows the sensor to be set in sequence or as a slave. The transceiver can be programmed to detect the shape of a single person or more than one person within the sensor's scan range. This way, the sensor can detect if more than one person is in the scan area of the sensor such as in section 90 or section 92.

Figure 5B:
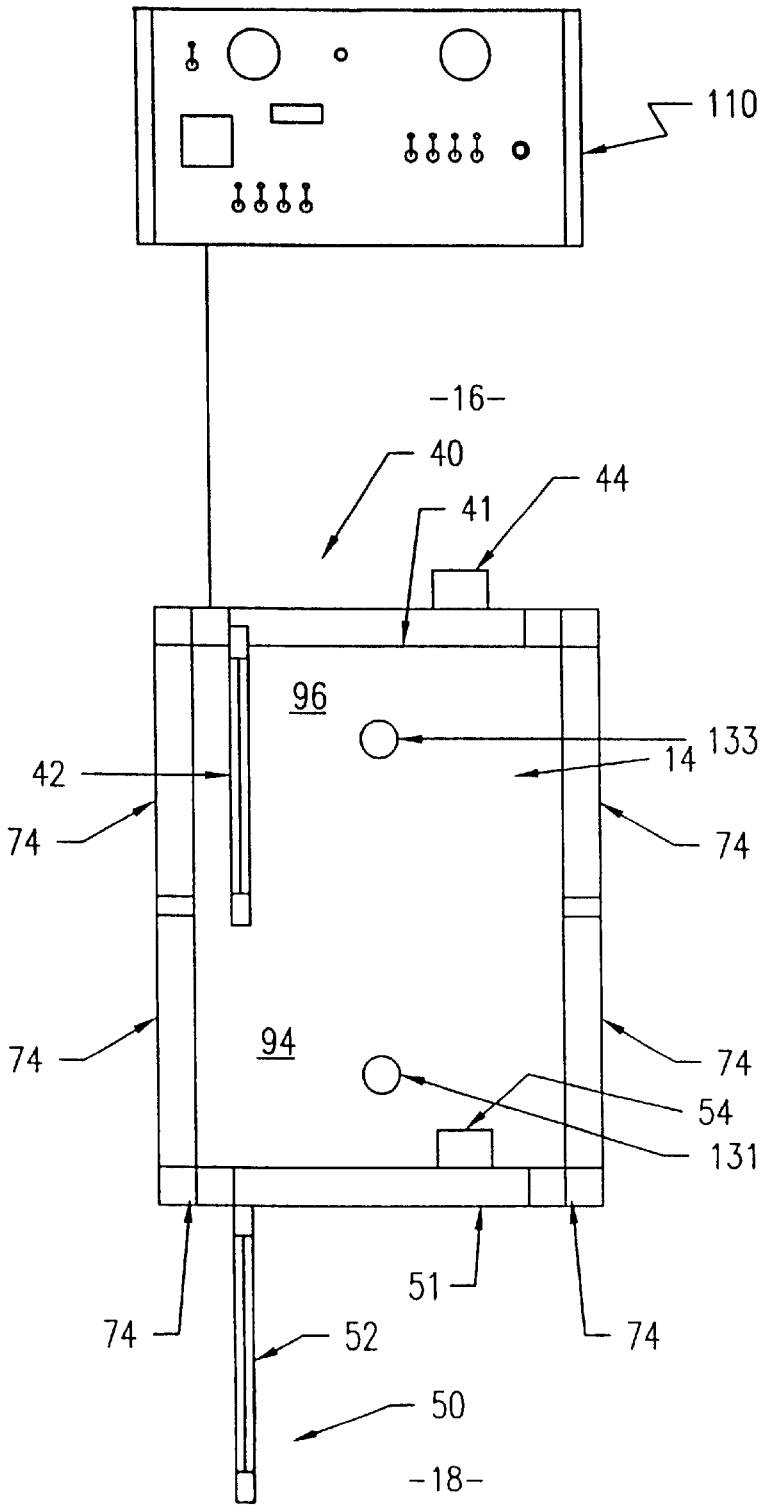
FIG. 5B is a schematic diagram of the exit chamber interlocking doors system.

FIG. 5B is a schematic diagram of the exit chamber 14 with its interlocking door system which controls egress from the secured facility. The exit chamber has two doors 40 and 50 on either end of the chamber which also preferably have electromagnetic locks (44 and 54) and touch bars (45 on FIG. 6D and 55 on FIG. 6C) mounted thereon. The interior No. 3 exit door 40 is normally in its closed position 41, but may be brought to an opened position 42 by activating the touch bar 45 (FIG. 6D) so that the door opens inward into the exit chamber 14. The exterior No. 4 exit door 50 is normally in its closed position 51, but may be brought to an opened position 52 by pushing push bar 55 (FIG. 6C) so that the door opens outward towards the exterior 18 of the secured facility. The exit chamber 14 may include sensors such as ultrasonic sensors to detect the presence of one or more people, or the presence of an object such as a weapon on the floor. If the sensor can scan the entire exit chamber 14, then only one is needed since it is not necessary to know what section a person is in.

Exiting the facility is accomplished by simply pushing the No. 3 door 40. If the chamber 14 is empty and No. 4 door 50 is closed, the person or persons are free to enter the chamber 14. Once in the chamber 14, an ultrasonic sensor will detect the person's presence and cause the third door 40 to be locked once the door closes, thus preventing re-entry to the bank or additional people from entering the chamber 14 from the bank. The person then must activate the push bar 55 (FIG. 6C) to unlock the fourth door 50 and exit the chamber 14.

If robbery occurs, the tellers are provided with a switch 181 (FIG. 4B) that will lock the fourth door 50 and trap the person in the chamber 14, not allowing egress. Doors 40 and 50 may also be locked from the control panel using the switches marked "3" and "4", (123 and 124 on FIG. 3).

If the person tries to stand off section 94 or section 96 by straddling and putting his feet on the aluminum framing 74(FIG. 6B), an ultrasonic sensor or sensors will detect the person in the chamber 14 and will prevent third door 40 from opening. Since it is not necessary to detect if more than one person is present in the exit chamber 14, only one ultrasonic sensor is required. More than one ultrasonic sensor may be needed if the floor space is large enough such that one sensor cannot cover the necessary area. If only one ultrasonic sensor above exit chamber 14 is used, then sections 94 and 96 would be combined into a single section 94 for purposes of describing the operation of the present invention.

If a person enters the chamber 14, leaves a weapon on section 94 or 96, and returns to the interior 16 of the secured facility, the ultrasonic sensors or sensor will detect the weapon on the floor and not allow the third door 40 to be open from within the bank until the chamber 14 is inspected and the weapon removed.

Figure 12A:
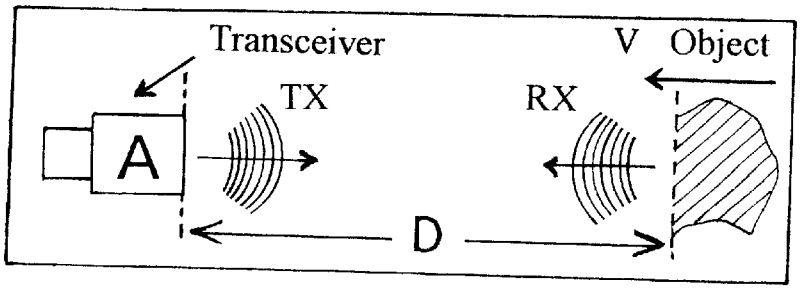
FIG. 12*a* shows a sonic burst sent from the ultrasonic transceiver and reflected off of an object.
Figure 12B:
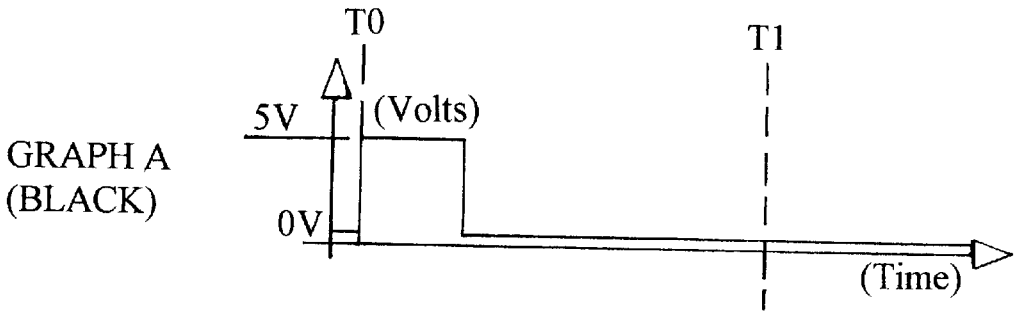
FIG. 12*b* shows an oscilloscope display of a signal from the ultrasonic transceiver.
Figure 12C:
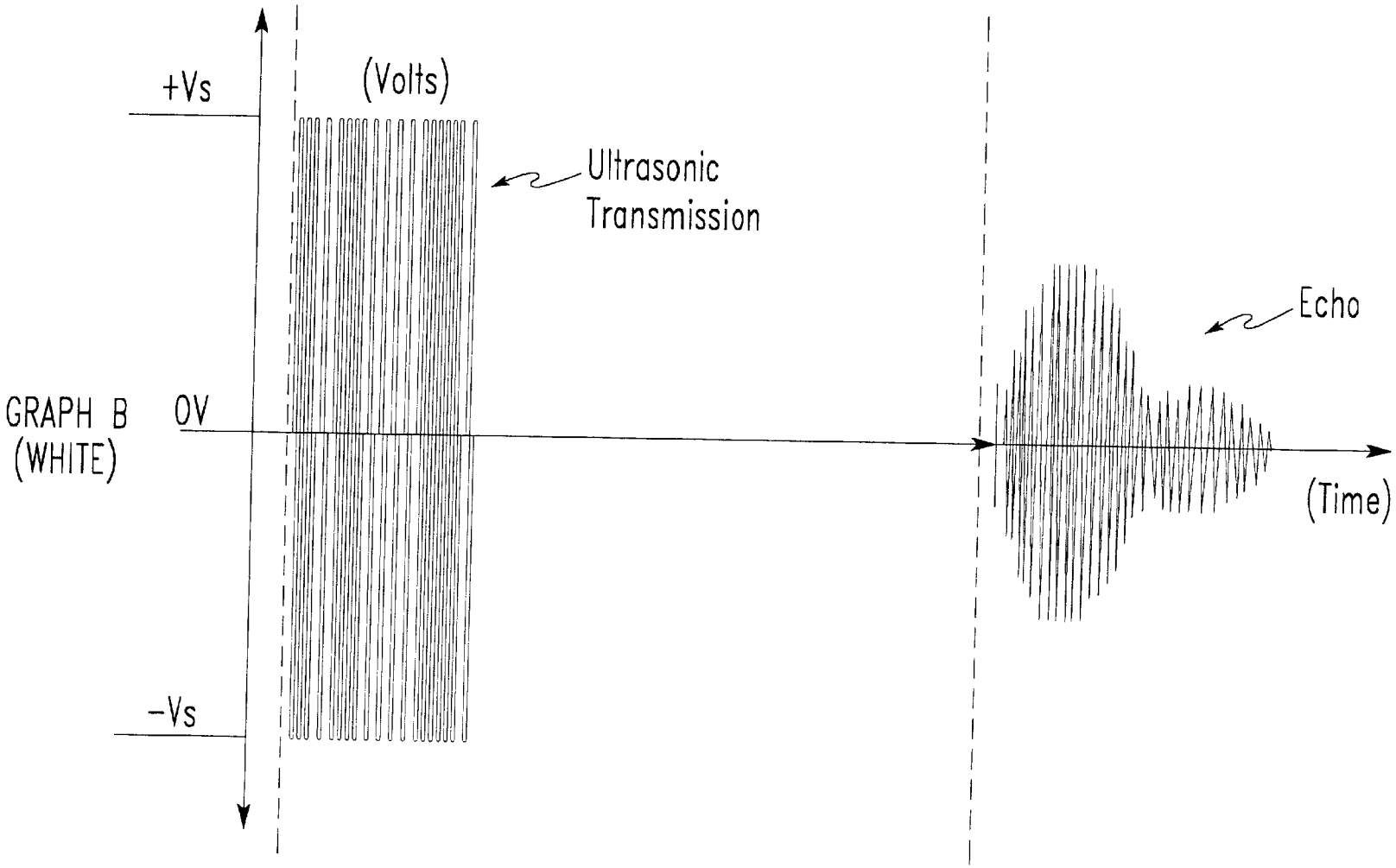
FIG. 12*c* shows an ultrasonic transmission from a transceiver and an echo from an object.
Figure 12D:
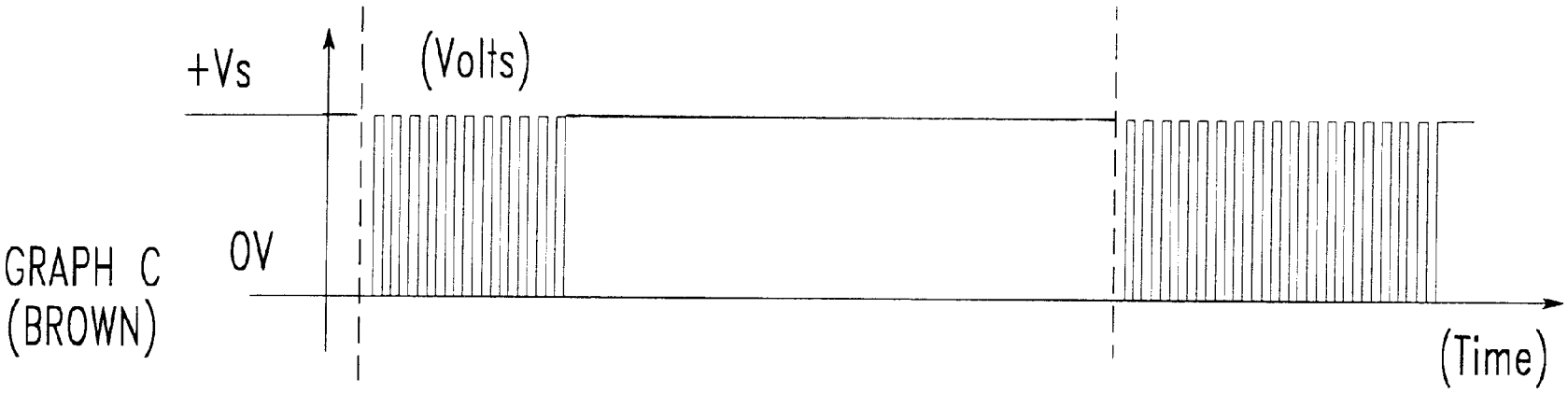
FIG. 12*d* shows a signal output from the transceiver.

FIG. 12A shows a representation of the transceiver transmitting a 40 K-hertz sonic wave (TX) through a distance (D) toward an object. The transmitted signal is reflected off the object as a reflected signal (RX) and returned to the transceiver. The transceiver determines if the reflected signal is similar to the signal stored in the memory. FIGS. 12B through 12D show the three wires connected to the transceiver and the signals carried by them. When a 5 volt power is supplied to the black power wire (FIG. 12*b*), an ultrasonic signal consisting of a cluster of sinusoidal waves with varying amplitudes is transmitted through the white wire (FIG. 12C). The signal applied to the black wire controls the length of the transmitted (TX) signal. The signals through the brown wire (FIG. 12D) are square pulses all the same in amplitude, and represent the echo signal off of an object.

For use in the vestibule of the present invention, four ultrasonic sensors are used—one for each of the four sections in the two chambers. The exit chamber can use a single ultrasonic sensor. They are preferably positioned on the ceiling of the chamber directly over and centered on the respective section of the chamber. Before use, each sensor would need to have its memory programmed. This is done by activating the sensor to scan for a period of ½ to 1 minute in duration. The sensor takes an average reading of all the echo's or return signals during this scan period, and stores that average in a non-volatile memory in the sensor. The sensor includes a battery backup on the chip to keep the memory in storage should power to the sensor be lost. Each sensor includes three electrical wires, one for a power line, another for a ground line, and the third for the alarm signal. If the echo from a sonic burst is within a specified deviation of that stored in the memory, then the alarm line is placed at a voltage of zero. If the echo from the sonic burst is outside the specified deviation, then the alarm line is placed at 5 volts. Thus, a control system could determine if an alarm event has occurred by measuring the voltage of the alarm line. The exit chamber can use only one transceiver to scan for an object such as a person or a weapon on the floor, since it is not important to scan for more than a single person in the exit chamber.

The sensitivity of the sensors can be set depending upon the environment for its use. For the present invention, an object the size of a knife or hand gun must be detected. Thus, a setting of the sensitivity for an object of thickness of is about ½ inch would accomplish the objectives of the present invention. This specific sensitivity setting would prevent false alarms due to normal vibrations of the vestibule, for example when a person enters and bangs one of the doors against the frame, or when a large and loud truck passes by. Vibrations in the vestibule could cause the echo from the sonic bursts to vary beyond the normal value (deviate). The vestibule is made from such strong materials as to prevent normal vibrations from shifting the ceiling more than ½ inch from that of the floor.

The vestibule would preferably include a control panel 110 which would provide multiple alarm features from a location remote from, but preferably in view of, the ACU 10. FIG. 3 shows a preferred embodiment of a control panel. The control panel 110 preferably has four door toggle switches 120 which may be marked "1,"2, "3," and "4" to control the doors 20, 30, 40, and 50 of the chambers 12 and 14.

The normal operational position of the door toggle switches 120 is preferably "down," indicating automatic actuation. One or more of the doors may be locked by toggling the desired door switch "up." Please note that these positions could be reverse without changing the intent of the invention. The control panel 110 may also include a second door 30 release button 130 to release the second door 30 if the metal detector 60 is activated. The second door 30 release button 130 would allow an operator to enter the entrance chamber 12 to inspect and/or remove the object which triggered the metal detector 60, or to permit the entry of a known wheel chair customer or a known armed policeman. Alternately or in addition to the second door 30 release button 130, a wireless transmitter and receiver second door 30 release button (not shown) may be included in the vestibule to allow a second operator to release the second door 30 from any position in the secured facilities. In the event that the main operator needs to leave his position near the main control box, such as for going to the bathroom or into the vault, the main operator can leave the wireless remote control box with a second person or operator. The second operator can then control the opening of the door from their own desk without having to travel to the main control panel.

The control panel 110 may also include an emergency button 132 that will release all doors (20,30,40 and 50) in the event of fire or any other emergency. The emergency button 132 may also be used to de-activate the vestibule at the end of the day when everybody is leaving the building and the doors are going to be locked with a key. In the preferred embodiment, the metal detector 60 remains on at all times after the system has been shut down for the night or after closing of the bank. Since the air in the bank or building contains water vapor, water can form on the electronics of the metal detector when the air conditioning in the building has been shut off or lowered due to closing. The water can short out the metal detector. I have found that leaving the metal detector on after the rest of the system has been shut off prevents the water from forming on the electronic circuit of the metal detector and eliminates the false alarms resulting from the electrical shorts.

The control panel 110 may also include means 140 for controlling specific alarm features. The alarm features may be controlled by an alternate action key switch 150 and toggle switches (142,143,144,and 145) may be set to operate only when the key switch 150 is in the "on" position 151 and not when it is in the "off" position 152. Preferably the toggle switches (142,143, 144 and 145) will only operate in a predetermined sequence (i.e., manager switch 142 enables police switch 143, etc.). These switches, however, could operate separately without changing the scope of the invention.

A switch 142 may be provided to activate an alarm to advise the manager of the institution if there is any problem. Another switch 143 may be provided to activate the panic alarm system of the institution that alerts the police department. Another switch 144 may be provided to activate an alarm inside the entrance chamber in case of someone brandishing a weapon. One or more additional features such as a switch for activating a camera or for providing means of subduing the person in the chamber such as by spraying the person with MACE, by the activation of a high pitched, high intensity siren, or by other known means.

It should be noted that the features described on the control panel 110 are meant to be exemplary and are not meant to limit the scope of the invention. For example, a reset button 134 may be provided to reset the vestibule. A metal detector alert means 135 such as speaker for a pulsating audible is sound or flashing LED may also be included. Another optional feature might be an ADA alert LED 136 may be provided to alert the operator that a disabled person needs assistance. There may also be intercom 138 with a microphone, speaker, is and controls which allows the operator to communicate with persons in the chambers 12 and 14. Further, the control panel may be constructed so as to utilize technology such as digital control buttons, analog switches and dials, mechanical means or any Know technology. For example, the toggle switches 140 may be replaced by capacitance actuated switches, by a key pad with numbered buttons, or a dial with specific positions.

Figure 4A:
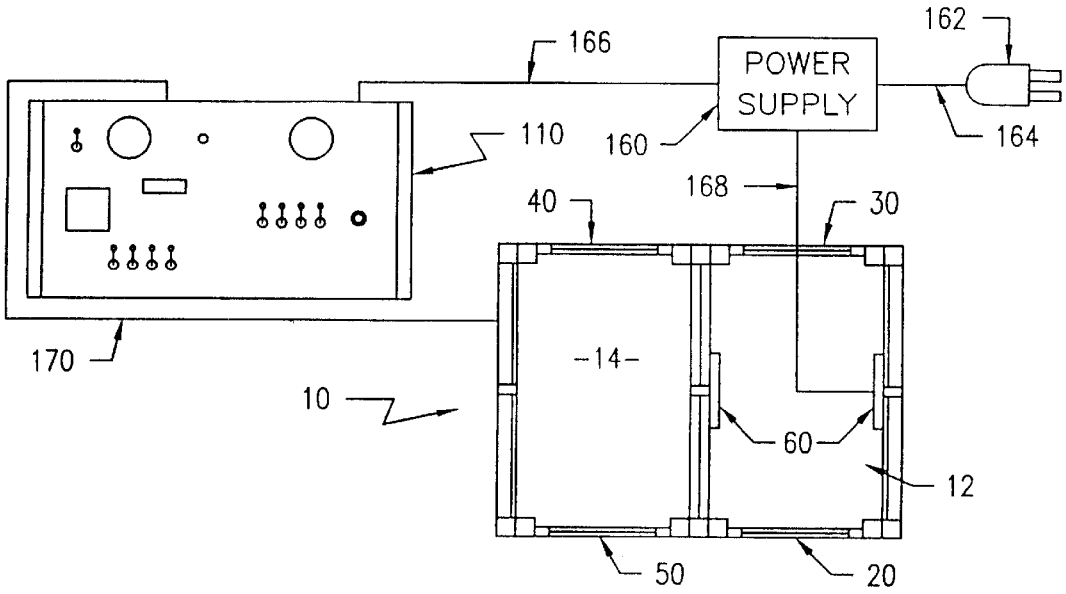
FIG. 4A is a schematic diagram of the connections between the teller's switches and the exit portal of the system.
Figure 4B:
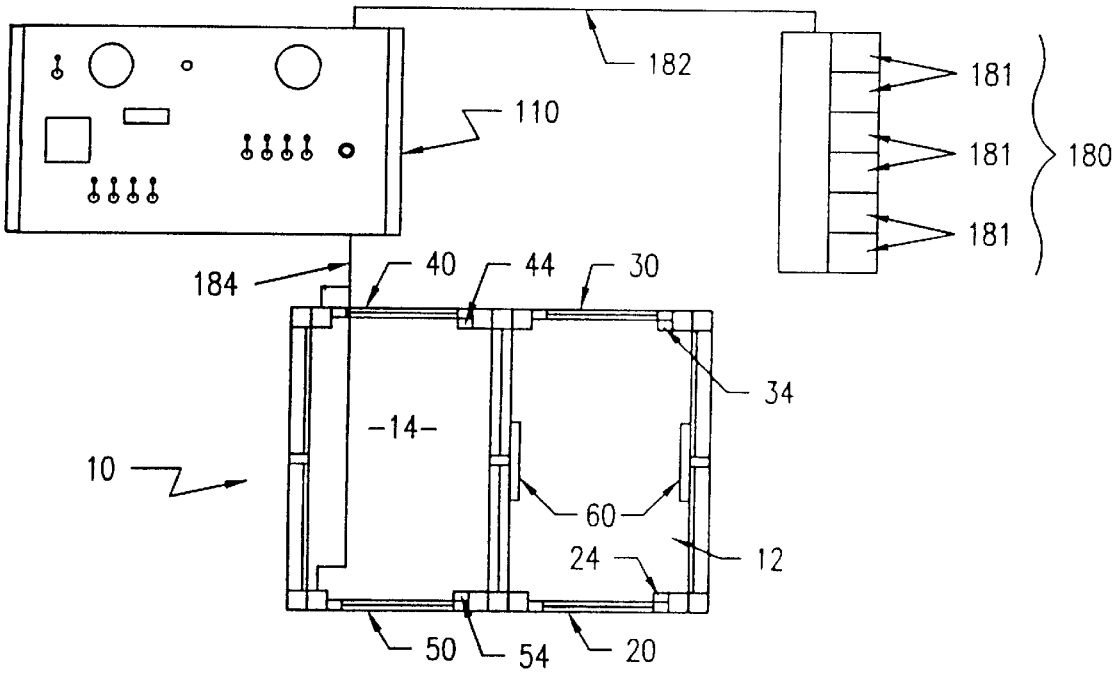
FIG. 4B is a schematic diagram of the connections between the teller's switches and the portal of the system.
Figure 4C:
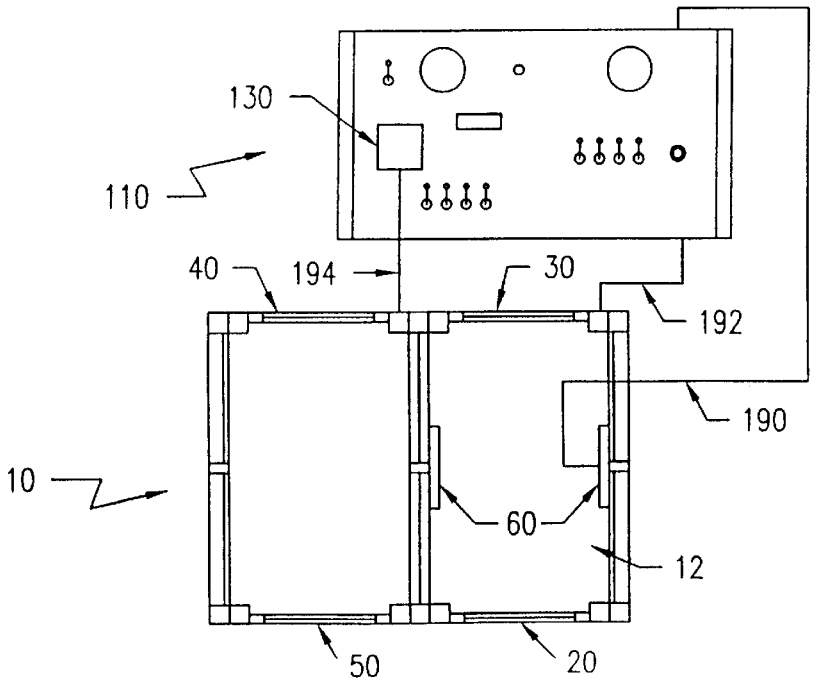
FIG. 4C is a schematic diagram of the connections involving the metal detector in the illustrated access control system.

The control panel may be connected to the vestibule as shown in FIG. 4A (power connections), FIG. 4B (connections between the teller's switches and the exit portal), and FIG. 4C (connections to the metal detector). The connection may be accomplished by means of "hard-wiring" or wireless means such as radio waves, infrared ray ultrasonic waves, or other means of wireless connection.

FIG. 4A shows a preferred power connection of the present invention. Power supply 160 is preferably a 24 VDC which may be connected by means 164 to a 110 VAC wall outlet power supply 162. The power supply may also be an independent power supply such as a battery or generator or may have similar means of back-up power supply in the event that power from the wall outlet 162 fails or is prevented. Using a 24 volt DC power source instead of high voltages like 110 AC or 220 AC (vac) would be safer, since a person is not likely to be electrocuted from 24 volts such as when installing the system or if a fired bullet was to electrically short the system out. Using 12 volts DC (vdc) would require more power and more current than would 24 vdc, and thus would also require larger wires to carry the larger current. Installing a system with 110 vac would also require a licensed electrician, and that would increase the cost of installing the system. A licensed electrician would not be needed with the smaller voltages of the present invention. Also, a battery backup for 24 vdc power supply would need only to use low-priced 24 volt batteries. A high voltage source like 110 vac would require an expensive uninterrupted power supply (UPS). Using an alternating current like 110 vac would also cause false alarms in the metal detector because of the electrical noise, surges and peaks. The power supply 160 is connected to the control panel 110 by wiring 166 to supply 24 VDC to the control panel 110. The power supply 160 is also connected to the metal detector 60 by means 168 to supply 24 VDC to the metal detector 60. 24 VDC is preferably supplied from the control panel 110 by wiring 170 to the ACU 10 to control such features as the Magnetic Locks (24 and 34 in FIG. 5A and 44 and 54 in FIG. 5B), push bars 25 and 55 in FIG. 6C and 35 and 45 in FIG. 6D), and other devices needing power (such as buttons, sensors, and alarms). These power connections are meant to be exemplary and are not meant to limit the scope of the invention.

Another benefit to using the 24 volts DC power supply is that the system can readily be adapted for use in countries around the world that use a wide variety of voltages. Some countries, like England, use 220 volts to make the system usable with the 220 volt power supply in England, all that needs to be modified is the voltage regulator in the power supply box, which is an inexpensive modification of about $40.

FIG. 4B indicates schematically the connections which allow employees, such as tellers, at fixed locations, such as the teller counter 180, to is remotely prevent exit from the exit chamber 14. This feature would allow a teller to prevent the escape of a robber. The teller counter 180 would have multiple switches or buttons 181 which the teller could use in the event of a robbery. The switches 181 are preferably connected to the control panel 110 by wiring 182. The control panel 110 then sends a signal via circuit 184 to the ACU 10 prevent the No 4 door 50 from opening by maintaining the magnetic lock 54 energized, as well as the magnetic lock 44 on the No. 3 door 40. These connections are meant to be exemplary and are not meant to limit the scope of the invention. For example, the teller switches 181 could be connected directly to the No. 4 door 50.

FIG. 4C shows the vestibule contacts for the metal detector 60. More specifically, the metal detector 60 sends a signal (when activated) by the circuit 190 to the control panel 110. The control panel 110 circuitry then operates through circuit 192 to hold No. 2 door 30 locked. An operator may release No. 2 door 30 by pushing a release button 130 whereby the control panel 110 sends a signal through circuit 194 to release No. 2 door 30. These connections are meant to be exemplary and are not meant to limit the scope of the invention. For example, the alarm signal from the metal detector 60 could be directly connected to No. 2 door 30. Also, as indicated above, there may be alternate methods of releasing No. 2 door 30. Normally, of course, when the entering person steps from the first section 90 onto the second section 92, without activating the metal detector 60, the second inference door 30 is unlocked; but this action is blocked is by a positive response from the metal detector 60.

Figure 6A:
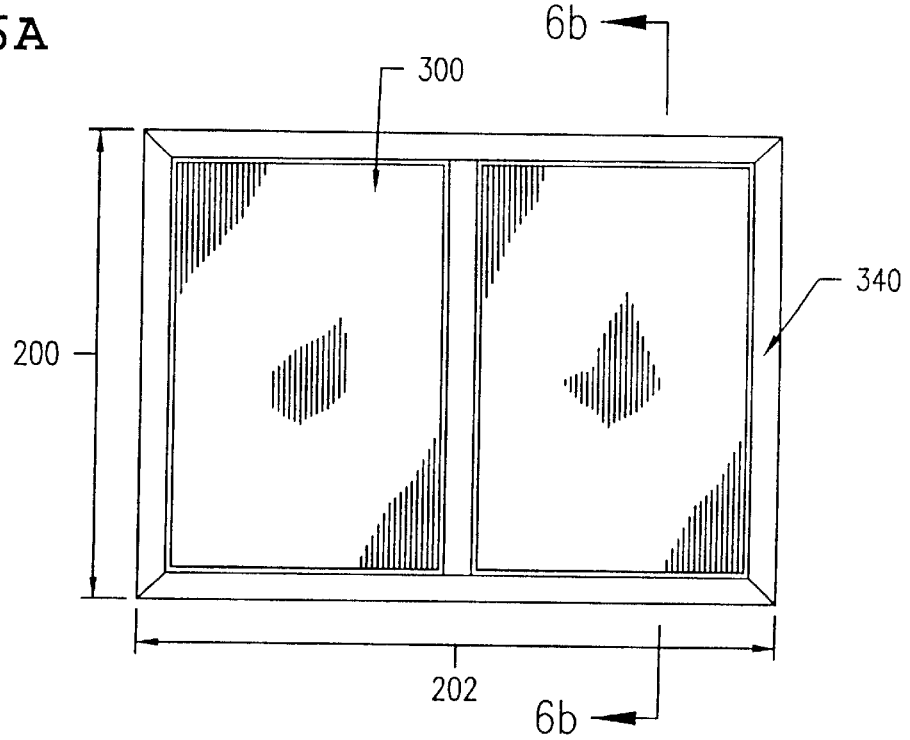
FIG. 6A is a schematic top view of the ACU of FIG. 2
Figure 6B:
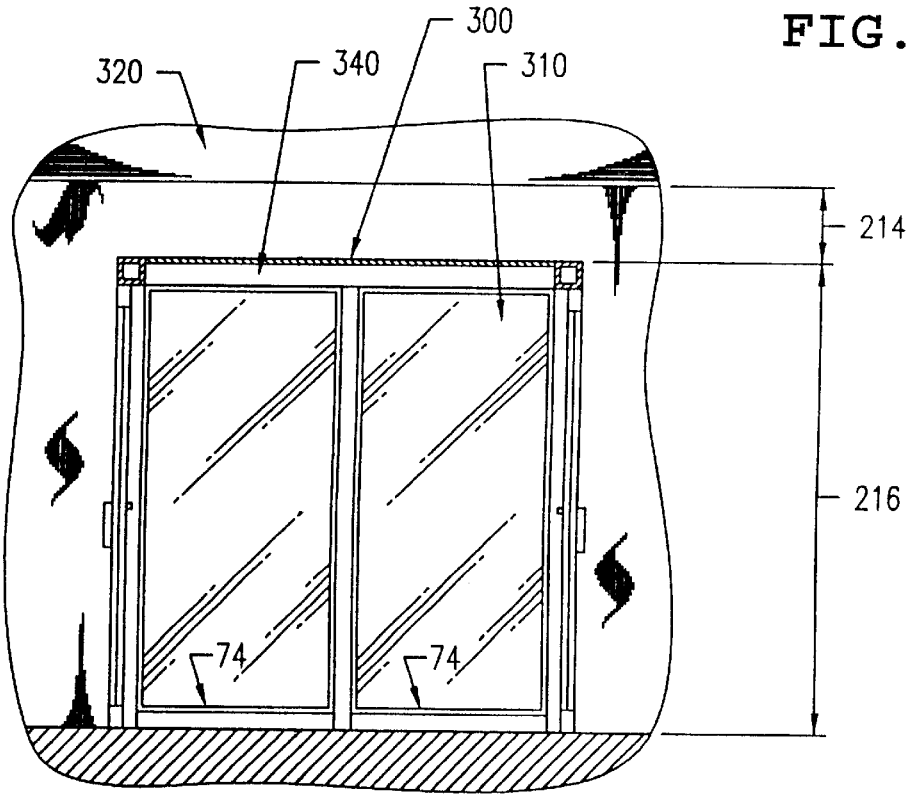
FIG. 6B is a schematic diagram of the ACU taken along line 6B—6B of FIG. 6-A.
Figure 6C:
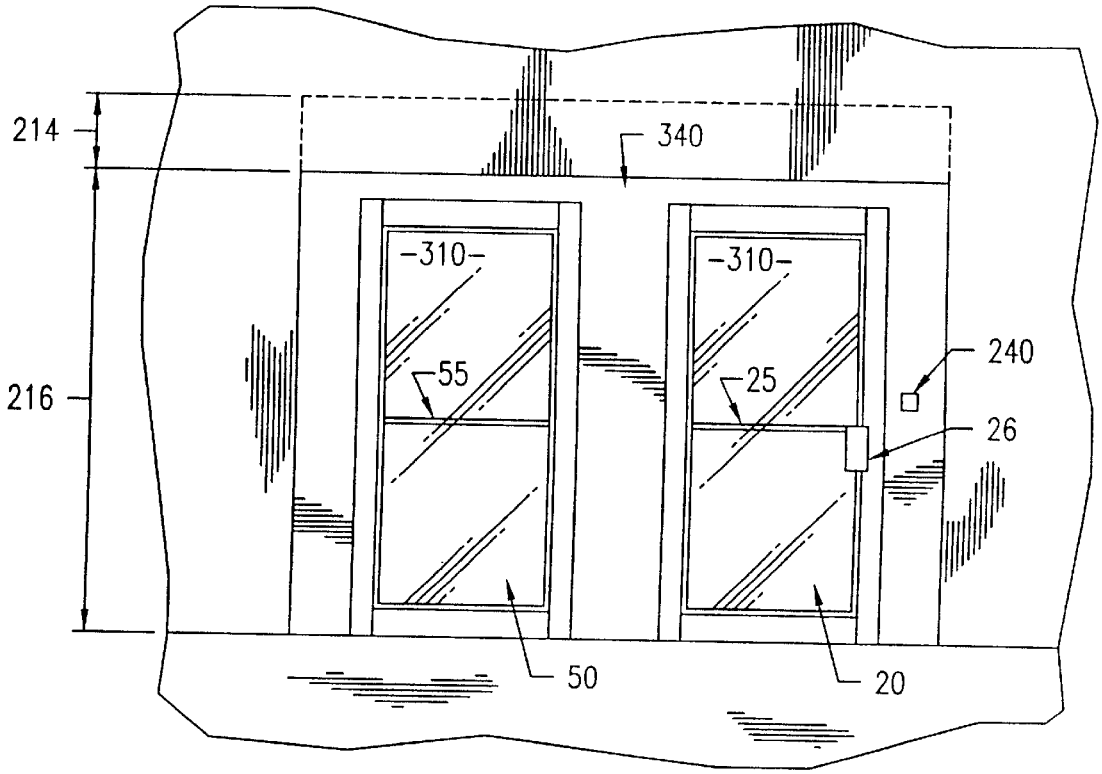
FIG. 6C is a schematic exterior view of the ACU.
Figure 6D:
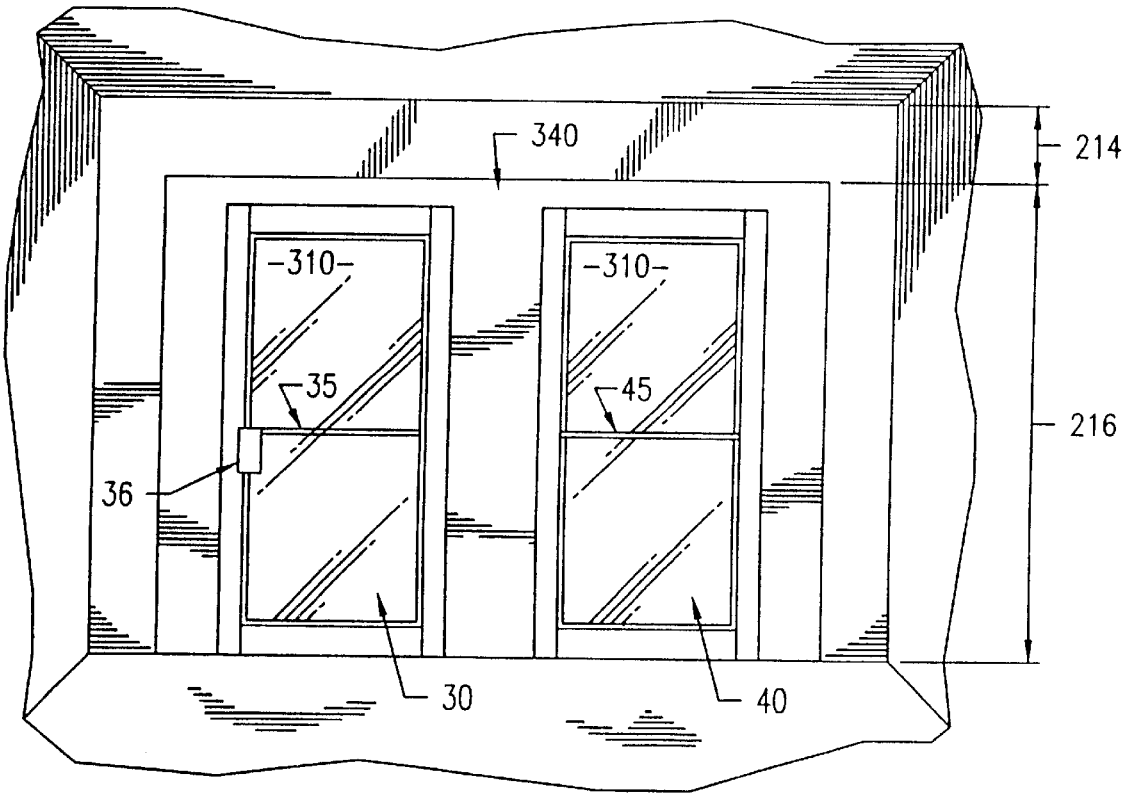
FIG. 6D is a schematic interior view of the ACU.

FIG. 6A is a schematic diagram of the preferred embodiment taken from the top view. The top panel cover 300, including the framing 340, has a length 200 of approximately 7 feet 5½ inches and width 202 of approximately 8 feet 3 inches. As shown in FIG. 2, the width 202 includes corner framing (204 and 212) of approximately 9¾ inches, doorways (206 and 210) of approximately 36 inches, and a central framing 208 of approximately 7½ inches. FIGS. 6B–D show that the preferred height 216 of the ACU 10 is approximately 7 feet and 4 inches. The clearance 214 between the top panel cover 300 and the ceiling 320 is preferably at least 2 feet and 0 inches. It may also be noted that the floor for accommodating the ACU is preferably level within approximately +/−¼ inches. The ACU may be positioned so that the face of the building is flush with the front of the ACU, flush with the back of the ACU.It should be noted that these dimensions are meant to be exemplary and may be adapted to correspond with specific needs of a user.

In passing, it is noted that regulations relating to disabled persons, using wheelchairs, require that the length of the entrance chamber 12 and exit chamber 14 be at least seven(7) feet, and that the width of the chambers be 36 inches.

FIGS. 6A–6D also show one embodiment of the framing system 340 of the ACU 10. The framing system 340 supports several glass or high strength transparent plastic panels 310. Both the framing system 340 and the glass panels 310 are made of materials which are preferably extremely strong and bullet proof glass or plastic to allow complete visual access to the ACU 10. The access chamber is formed of aluminum framing along all the sides of the box-shaped chamber. The framing secures the glass and plastic panels in the sides and doors such that the inside of the chamber is almost completely visible from the outside. Using the same material for the side walls and doors significantly reduces the cost of the access control chamber and makes it easier to manufacture and install. An assemblyman needs only a basic knowledge of assembling the frame members with the glass panels secured within the framing.

FIG. 6B shows a side view of the access chamber in which the sides are formed of two pieces of glass and separated by a vertical frame member. Using two sections instead of one large piece of glass is beneficial, since the smaller sections are lighter than the larger one which allows for manual installation of the glass. No power equipment is required as would be for a piece over 8 feet long and 7 feet high. Also, the middle frame section provides more structural support to the entire access chamber than would the single glass piece as shown in the Urbano patent. Also, if the glass was to be broken due to a fired bullet, only the one damaged glass panel would need to be replaced instead of the whole side section as would be required in the Urbano patent.

Figure 7:
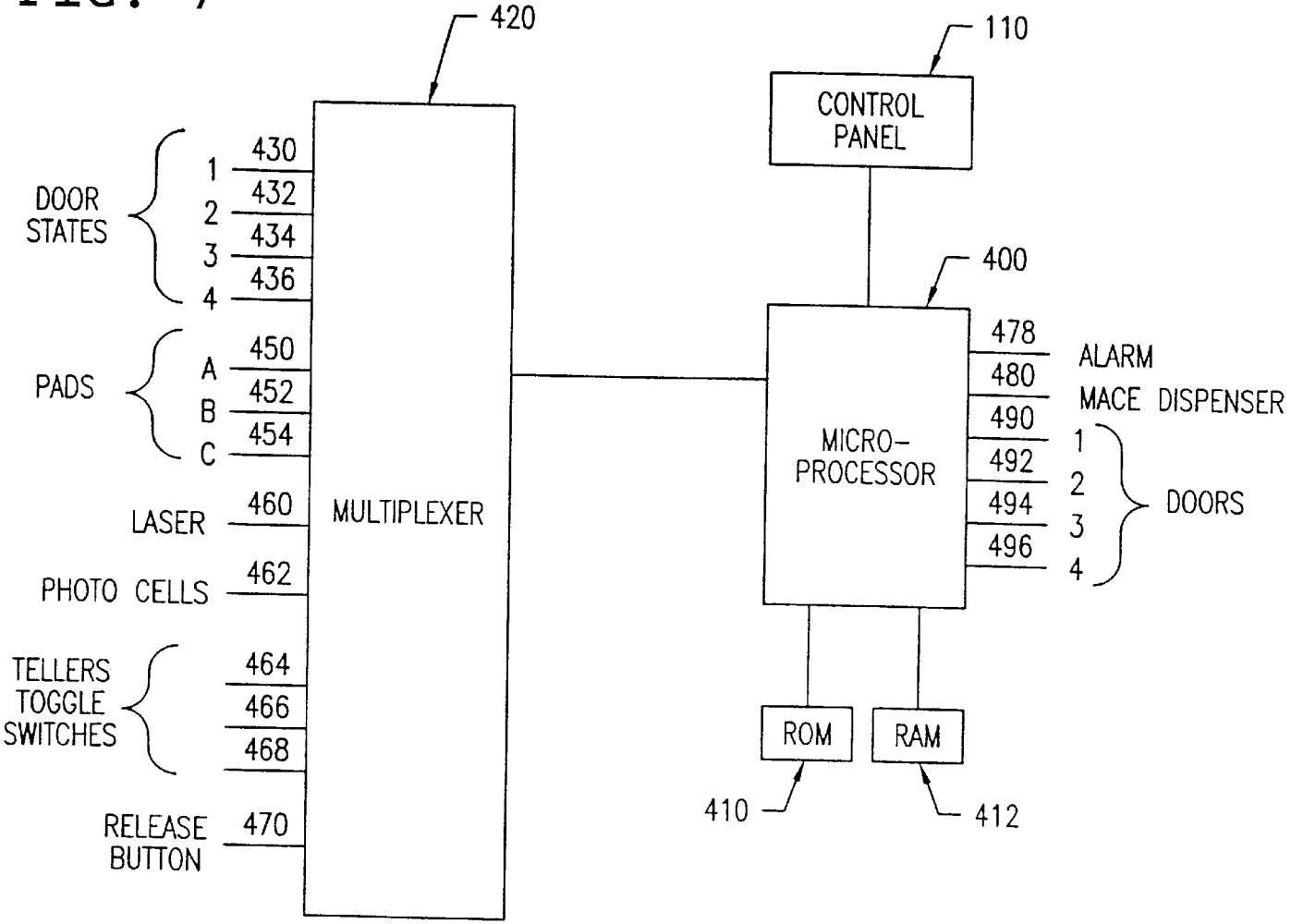
FIG. 7 is a block circuit diagram of one embodiment showing the electronic connections of the access control system.

FIG. 7 shows a block diagram of a simplified embodiment of the electronic connections of the present invention. The system would be controlled by a microprocessor 400 which includes or is attached to memory such as read-only memory (ROM) 410, and Random Access Memory (RAM) 412. The microprocessor 400 would receive input, generally supplied through a multiplexer 420, from various elements of the vestibule. This input could include but is not limited to the input circuits providing the status of the control panel 11 0, inputs from door sensors (to detect if the door is closed) for each of the doors (430, 432, 434, and 436), inputs from each of the ultrasonic sensors (450,452, and 454) inputs from the tellers toggle switches (464, 466, and 468), and an input from a wireless door release button 470. The microprocessor controls elements of the system including but not limited to the alarm 478 and the magnetic locks on each door (490, 492, 494, and 496) in accordance with the operational diagrams of FIGS. 8A through 8G.

Figure 8A:
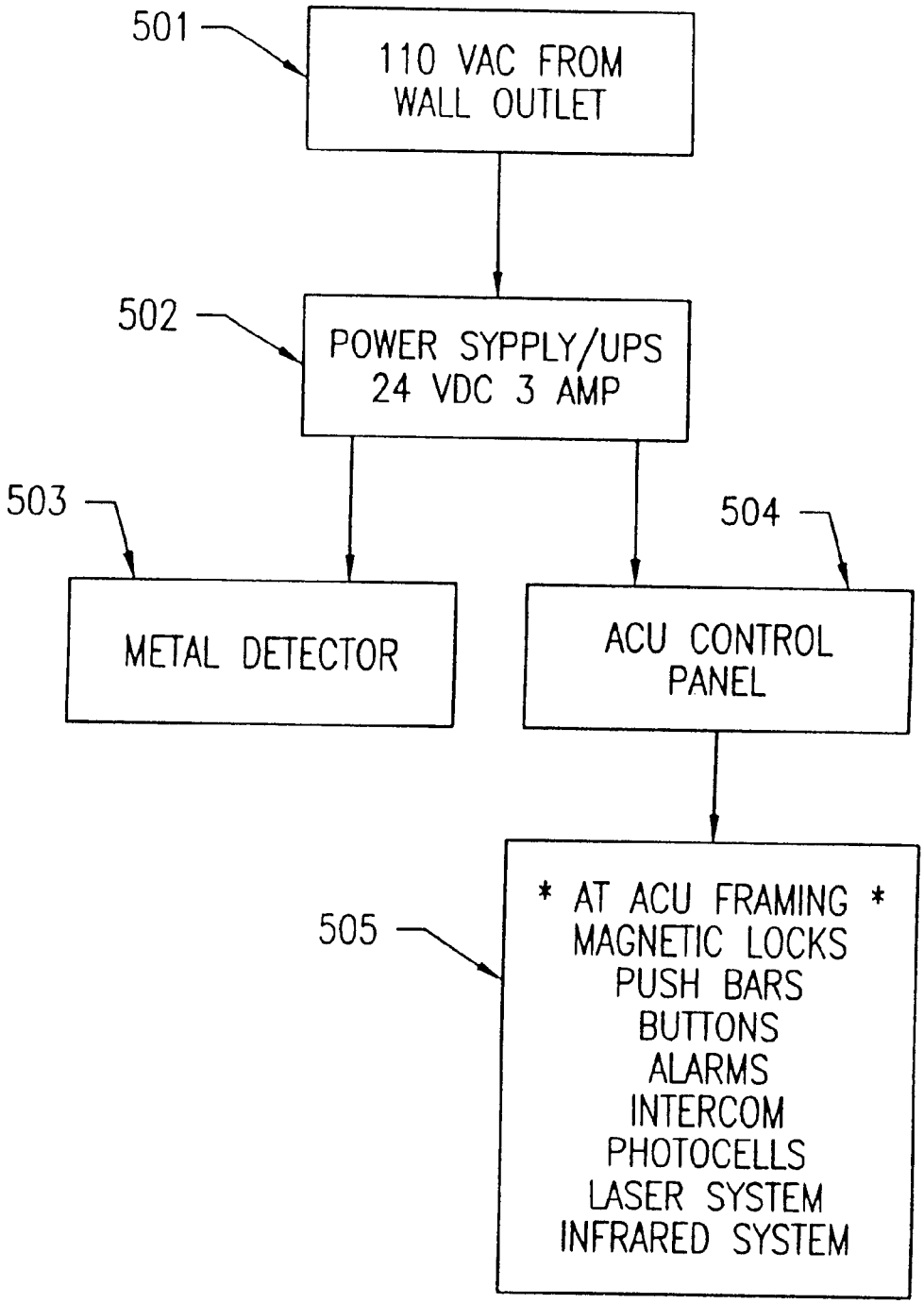
FIG. 8A is a block diagram of the power requirements of the present access control system.

FIG. 8A is a block diagram of one embodiment of the power requirements and system shown in FIG. 4A. 110 VAC from a wall outlet as indicated by block 501 is input into a power supply 502. The power supply 502 supplies power to the metal detector 503 and the ACU control panel 504. The ACU control panel 504 in turn supplies power to the magnetic locks, push bars, buttons, alarms, intercom system (speakers 220 shown in FIG. 1), ultrasonic sensors, and other elements of the ACU requiring power as indicated by block 505.

Figure 8B:
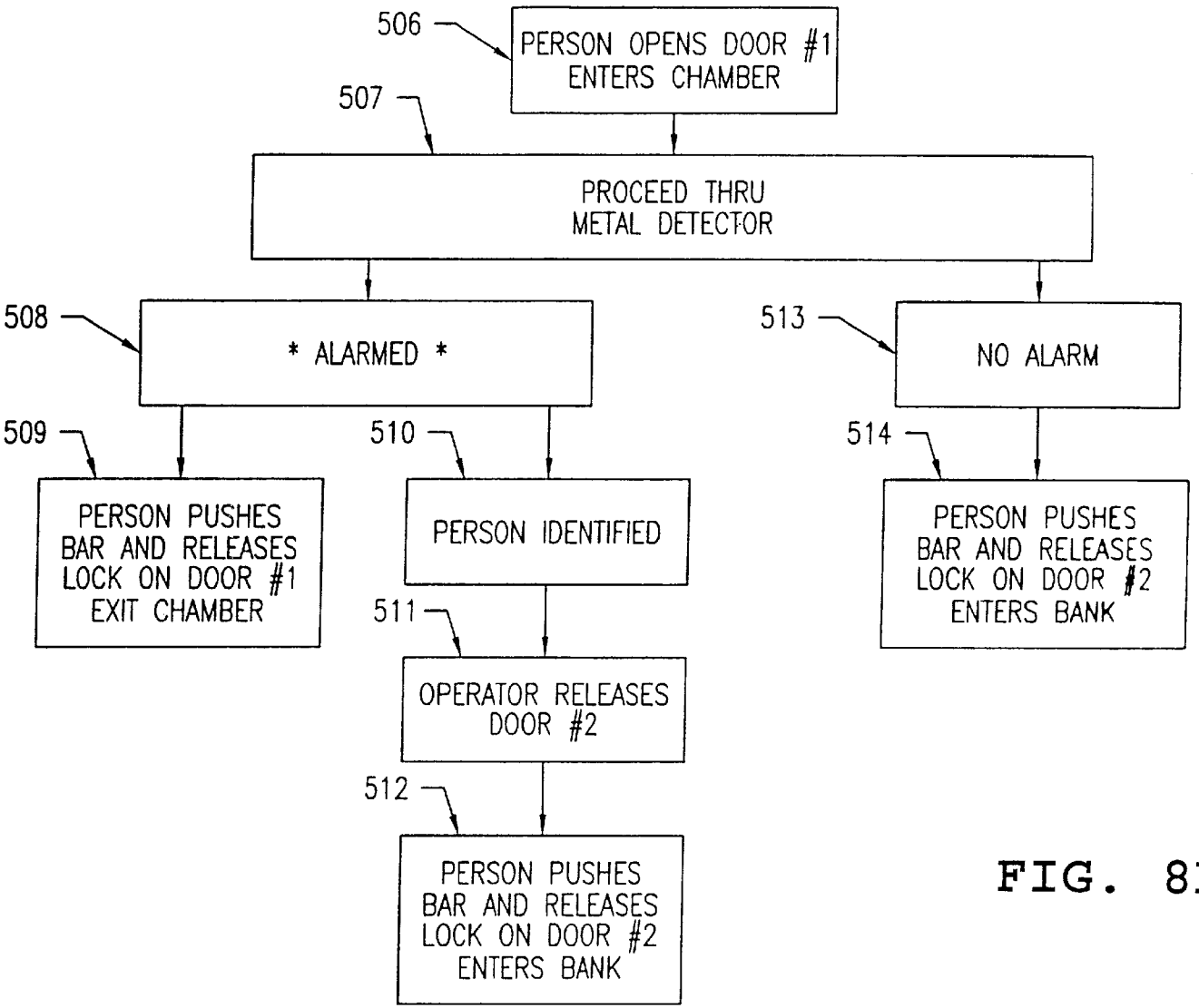
FIG. 8B is a block diagram of the entrance chamber metal detector interface of the present system.

FIG. 8B shows the entrance chamber metal detector mode of operation in block diagram form. The interface is triggered when a person opens door No. 1 and enters the entrance chamber 12 as indicated by block 506. The person then proceeds through the metal detector 60, see block 507. If no metal is present, the alarm does not sound, see block 513 and the person pushes the bar to release the lock on the inner entry door 30 and enters the secured facility as indicated by block 514. If metal is present, the alarm is triggered, per block 508 by the metal detector. The system may be configured to allow him to leave the weapon on section 92, push the bar to release the lock No. 1 door 20 and exit the entrance chamber to the exterior of the secured facility, see block 509. If the person in the entrance chamber is an identified law enforcement officer, is a disabled person in a wheelchair, or is otherwise identifiable to the operator 510, the operator may release the No. 2 door 30, per block 511 and thus allow the person to push the bar to release the lock on inner entry door 30 and enter the secured facility as indicated by block 512.

Figure 8C:
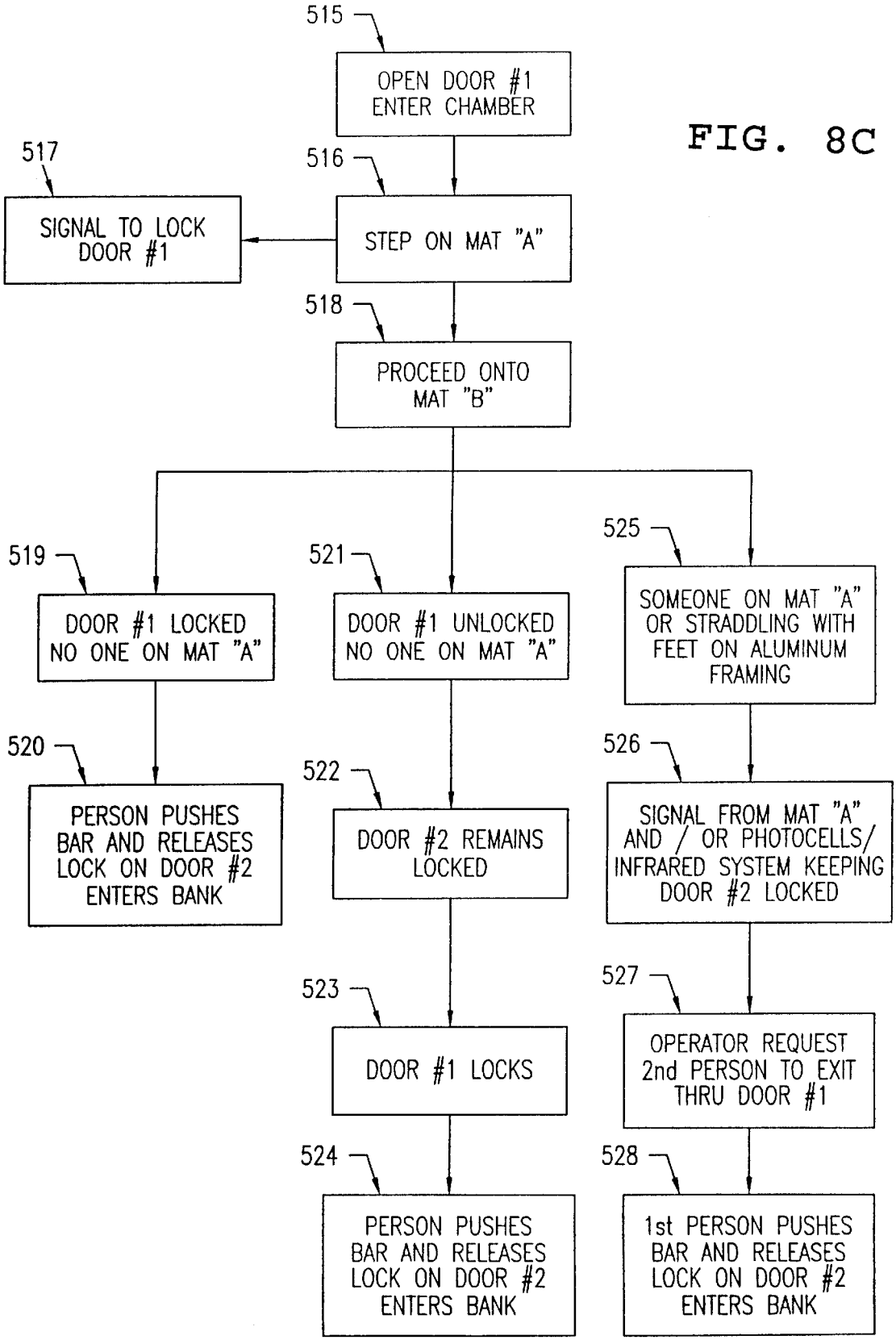
FIG. 8C–8D are block diagrams of the entrance chamber interlocking doors system of the present ACU invention.
Figure 8D:
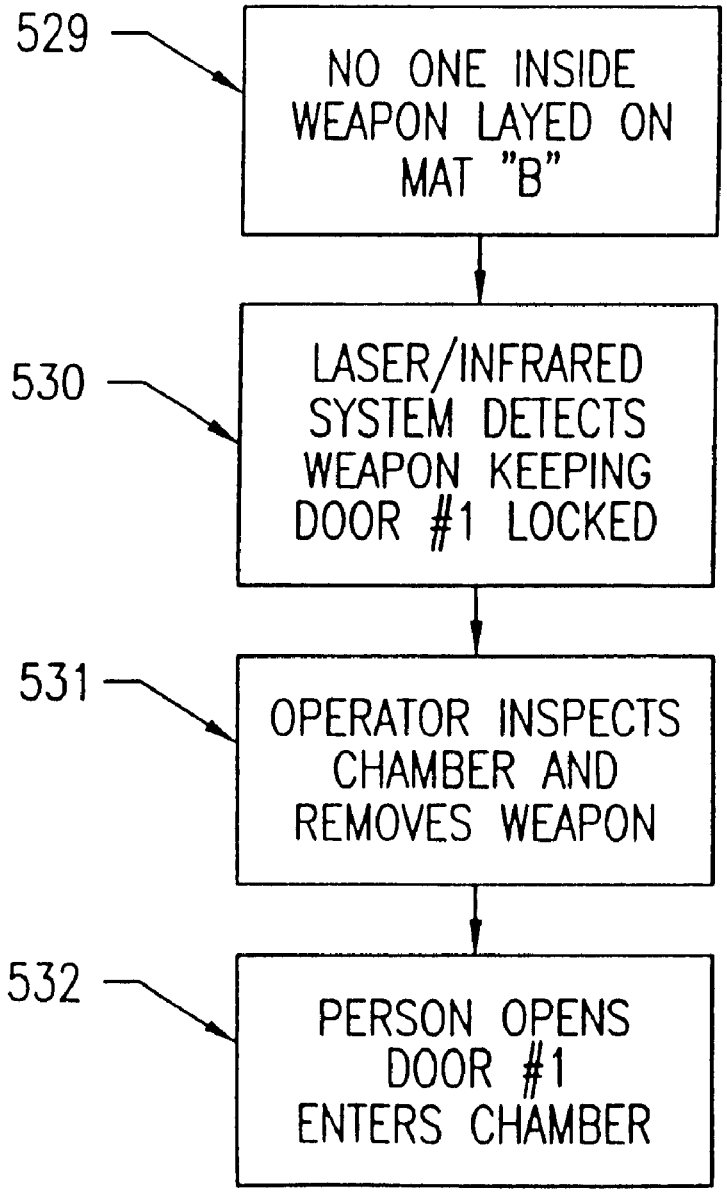

FIG. 8C and 8D show the mode of operation on the entrance chamber interlocking door system in block diagram form. When nobody is using the doors or is inside the entry chamber 12, the No. 1 outer entry door 20 may be opened and a person may enter the entrance chamber as indicated 515. When the person steps on section 90 per block 516, a signal is sent to lock No. 1 door 20, per block 517 so it is secure and cannot be opened from the outside. The person then passes through the metal detector 60 and proceeds onto section 92, see block 518. When no one is-on Mat "A" and the No. 1 door is locked per block 519, the person may open the inner No. 2 entry door 30 and enter the secured facility, as indicated by block 520 if the metal detector is not activated. If outer No. 1 entry door is unlocked and no one is on section 90 per block 521, and door No. 2 remains locked, then door No. 1 locks, per block 523 and the person may open inner No. 2 entry door 30, and enter the secured facility per block 524.

However, if two people enter through door No. 1 and one of them stands on section 90 and the other stands on section 92, door No. 2 will not open. If one of the persons tries to stand off the section by straddling and putting the feet on the aluminum framing, see block 525, the ultrasonic sensors will detect the persons' presence and will not allow door No. 2 to open, per block 526. In this case the operator may request the second person to exit through door No. 1 as indicated by block 527. The person remaining in the entry chamber 12 may then open door No. 2 and enter the secured facility, per block 528. Finally, as shown, in FIG. 8D, if no one is inside the chamber 12, but a weapon is on the floor, per block 529, the sensor system will detect the weapon and keep door 20 locked in accordance with block 530 until operator inspects the chamber and removes the weapon, see block 531. A person may then push open outer entry 1 and enter the entrance chamber, per block 532.

Figure 8E:
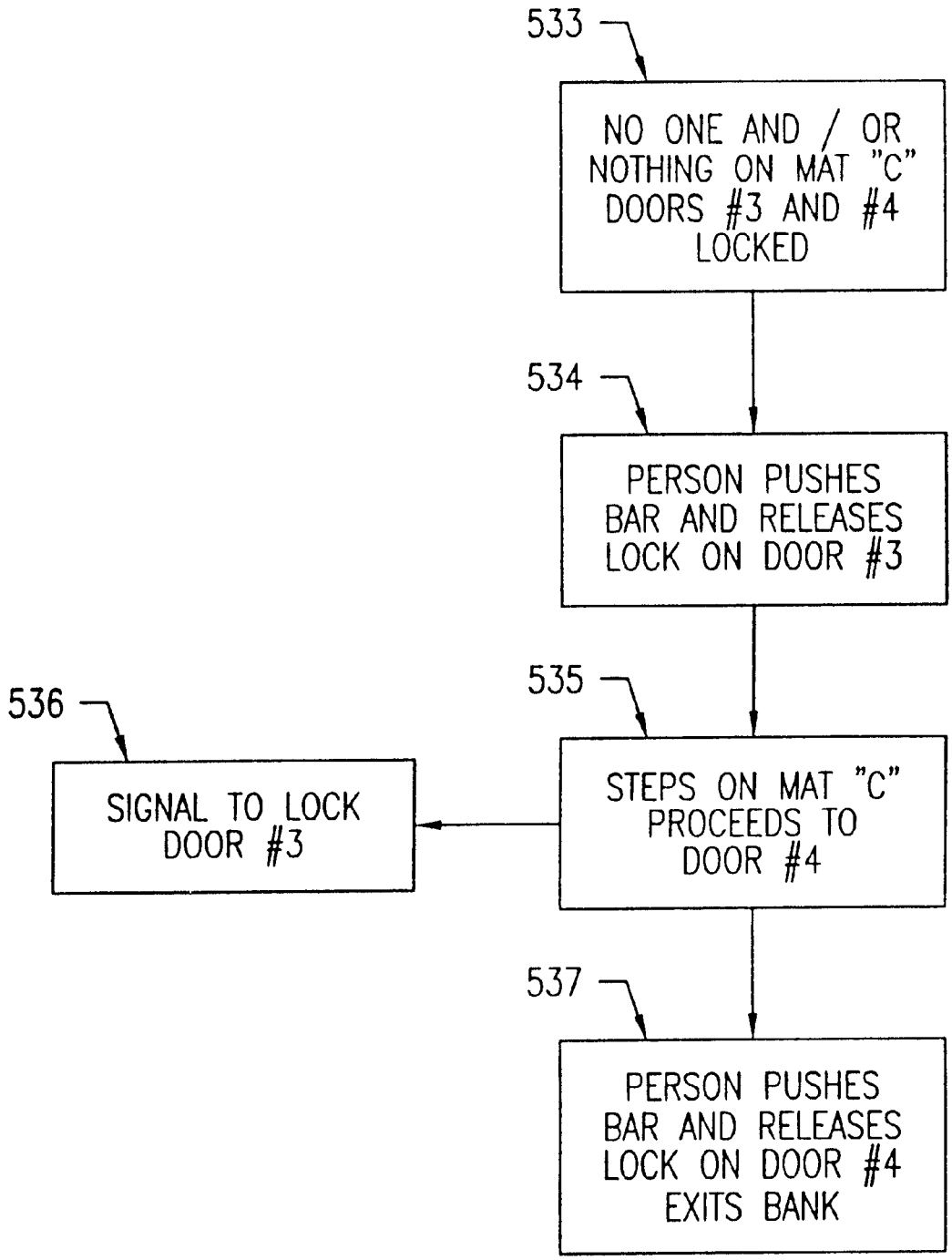
FIG. 8E–8F are block diagrams of the exit chamber interlocking doors system of the ACU.
Figure 8F:
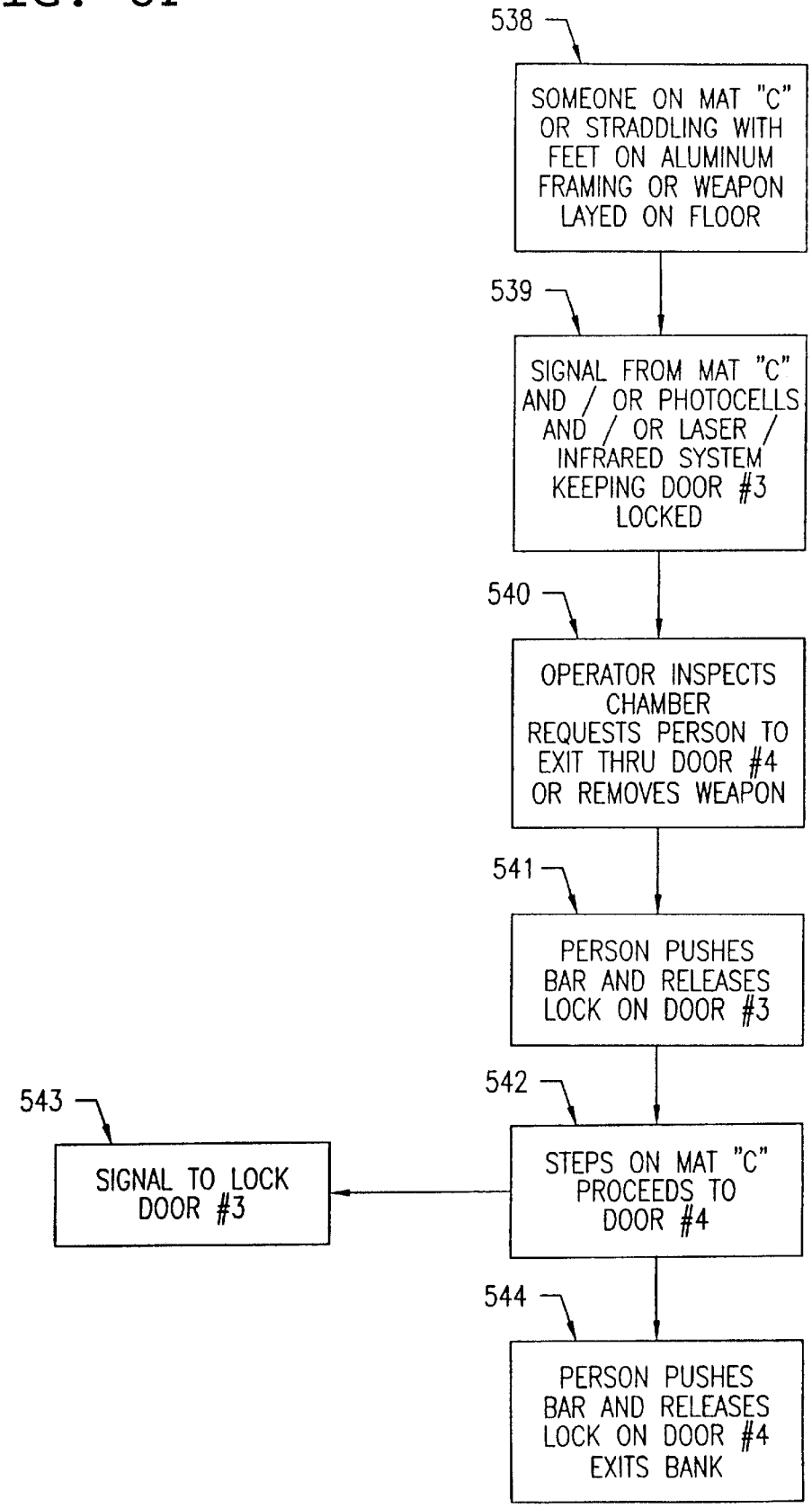

FIGS. 8E and 8F are block diagrams of the mode of operation of the exit chamber 14 interlocking door system of the present invention. As shown in FIG. 8E when there's nobody using the doors or inside the chamber, doors No. 3 and No. 4 are locked as shown by block 533. When somebody is leaving the secured facility and touches the electronic bar on door No. 3, the lock is released (see block 534). As the person steps on section 94 (block 535), a signal is sent to lock door No. 3, per block 536 so that it cannot be opened from chamber 14. The person then can open door No. 4 by activating the push bar to release the lock, and exit the secured facility in accordance with step 537.

As shown in FIG. 8F, if the person tries to defeat security by standing off the floor by straddling and putting his feet on the metal or aluminum framing, or by laying a weapon on the floor, per block 538, a ultrasonic sensor or sensors will detect these circumstances, and a signal will be sent to prevent inner exit door No. 3 from being opened, per block 539. An operator may then inspect the chamber, request the person to exit through door No. 4, or remove the weapon, per block 540. A person may then push the bar on door No. 3 to release the lock 541. As the person steps on section 94, per step 542, a signal is sent to lock door No. 3 (543) so that it cannot be opened from within chamber 14. The person then can open door No. 4 by activating the push bar to release the lock and exit the secured facility, in accordance with step 544.

Figure 8G:
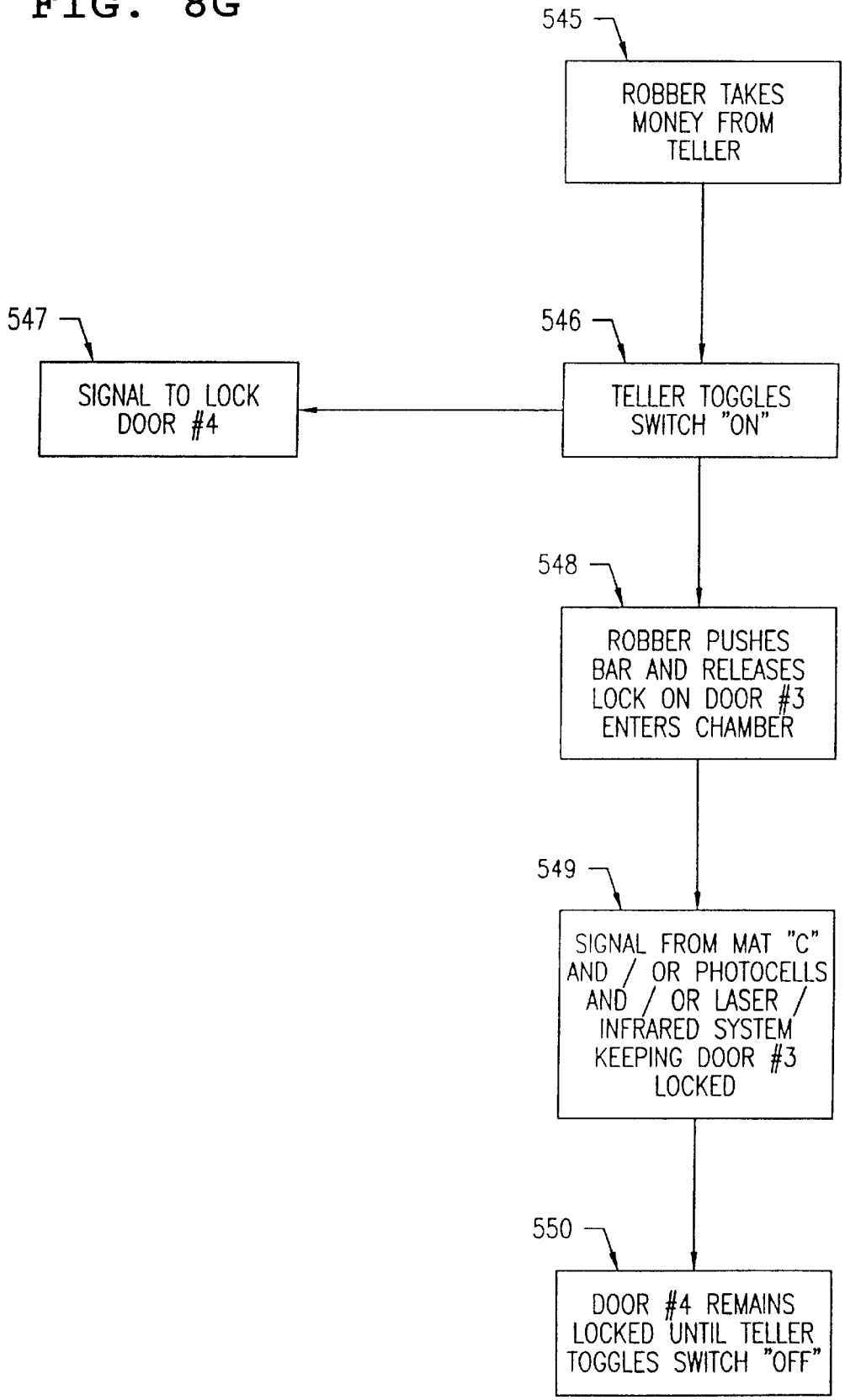
FIG. 8G is a block diagram of the operation of the tellers' toggle switches to close exit chamber of the access control system.

FIG. 8G is a block diagram indicating the operation of the teller's toggle switches to lock the exit chamber. When a robber takes money from a teller as indicated by block 545, the teller toggles a switch "on" as indicated by block 546. A signal is then sent directly or indirectly to lock door No. 4 as indicated by block 547. The robber pushes the push bar on door No. 3 and releases the lock on door No. 3 and enters the exit chamber 14, as indicated by block 548. When the robber steps on section 94, the ultrasonic sensor directly above senses his presence, and a signal is sent from the ultrasonic sensor which keeps door No. 3 locked as indicated at block 549. The robber is unable to leave the exit chamber 14 because door No. 4 remains locked until the teller toggles the activated switch "off" per block 550. The robber is thus held in exit chamber 14 until the police arrive.

As described above, the ACU 10 is designed to control or meter access into and egress out of a secure facility using an entrance chamber 12 having dual interlocking entrance doors (20 and 30) and an exit chamber 14 having dual interlocking exit doors (40 and 50).

In the preferred embodiment, electromagnetic locks (24, 34, 44, and 54) would be positioned on the top frame of the ACU as shown in FIGS. 5A and 5B. The locks would come into contact with a magnetic strike plate (not shown) on the corresponding top frame of the door. When activated, the electro-magnetic locks would secure the doors. When released, the electromagnetic Jocks would allow the doors to open. An electro-magnet access control circuit such as that described in U.S. Pat. No. 4,682,801 to Cook et al. and assigned to Securitron-Magnalock Corporation would be appropriate to use with the present invention. A magnetic locking status detection system such as the one described in U.S. Pat. No. 4,516,114 to Cook and assigned to Securitron-Magnalock Corporation could be used to connect the electromagnets to the microprocessor 400 (FIG. 7) and provide status information.

The touch bars (25, 35, 45, and 55) as shown in FIGS. 6C and 6D may be part of a touch bar release locking system of the type described in U.S. Pat. No. 4,871,204 to Cook et al. and assigned to Securitron-Magnalock Corporation.

The doors would each include a high security closure device. The closure device would return the door to the closed position after the door is released by a person passing through. The high security closure is a solid metal bar pivotally connected at one end to the underside of the frame of the vestibule, and connected at the other end to a slot in the top surface of the door frame so that the end of the closure slides along the slot in the door. The closure bar does not have an elbow joint, which makes the closure even more secure.

Figure 8H:
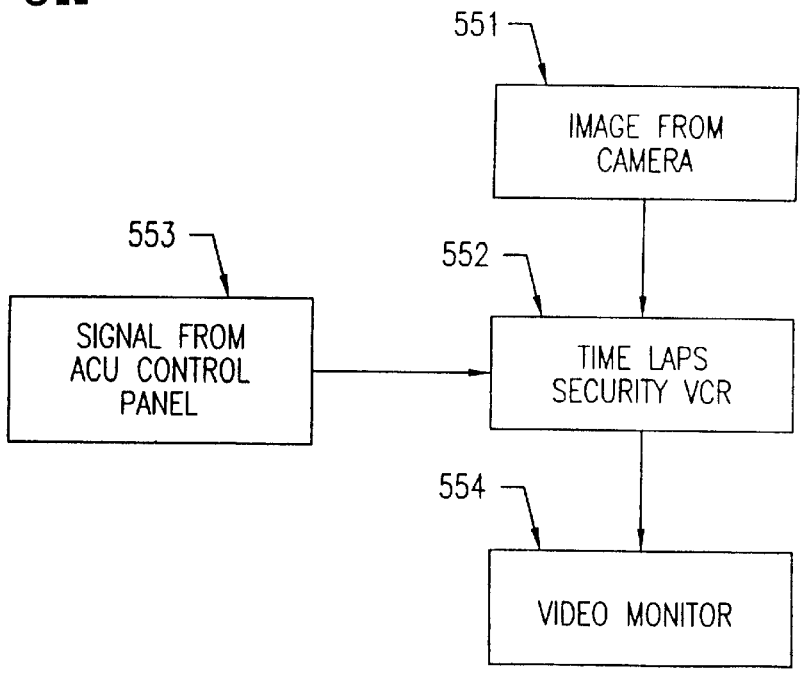
FIG. 8H is a block diagram of the entrance chamber camera system interface of the system.
Figure 8J:
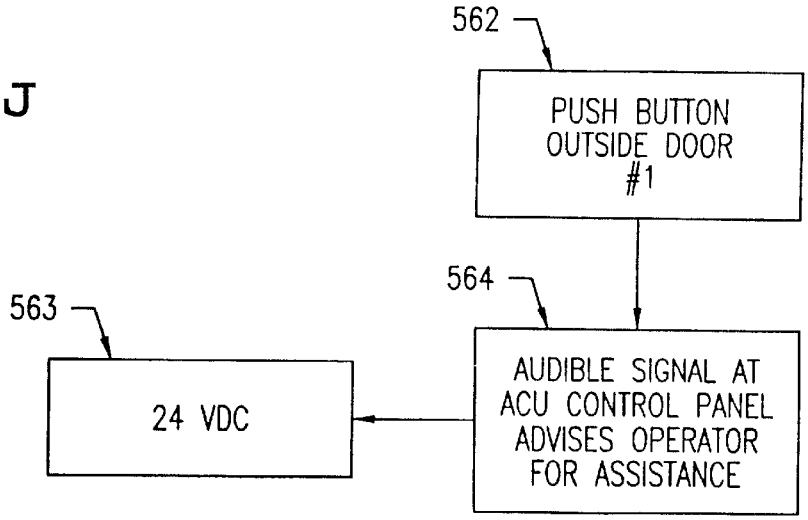
FIG. 8J is a block diagram of the operation of the ADA assistance push button arrangements the access control system.

FIG. 8H is a block diagram of the operation of the entrance chamber camera system interface which may be included in the present invention. More specifically, a closed circuit TV system may work in conjunction with the vestibule to provide a record of people that activate the metal detector 60. The camera system (as shown schematically in FIG. 1) may include a camera 230 installed at the entrance chamber 12, a time lapse security video recorder 232, and a monitor 234. The camera system is activated by the metal detector 60 or by the control panel 110. If a signal is sent from the control panel or metal detector 60 as indicated by block 553, the time lapse security VCR per block 552 requests and receives an image from the camera as indicated by block 551. The time lapse provides the image to the video monitor as indicated by block 554.

Figure 8I:
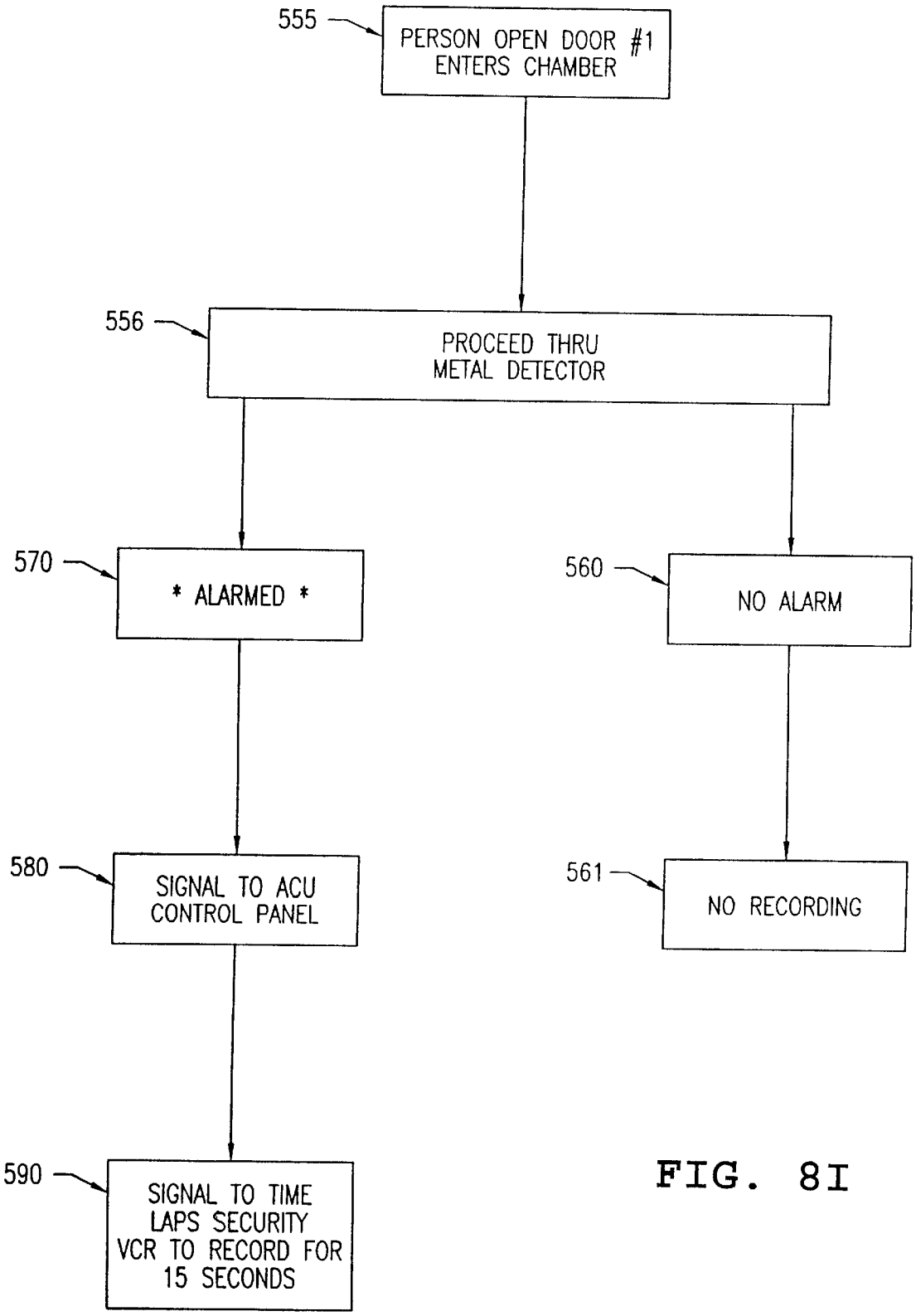
FIG. 8I is a block diagram of the entrance chamber metal detector system interface of the system.

FIG. 8I is a block diagram setting forth the mode of operation of the entrance chamber metal detector system as it interfaces with the camera system. A person enters the entrance chamber 12 as indicated at block 555 and proceeds through the metal detector, see step 556. When the metal detector is activated or alarmed as shown at block 570, it sends a signal to the control panel 110 as shown at block 580. The control panel 110 sends a signal to activate the time lapse security video recorder 232 for 15 seconds as shown at 590 and records the person for that period. If no metal is detected, then there is no alarm as indicated by block 560 and the video recorder does not make a recording as indicated by block 561.

The present invention is preferably adapted for use with handicapped persons. For example, as shown in FIG. 6C, the ACU 10 is provided with a handicapped assistance push button 240 outside No. 1 door 20 is activated as indicated by block 562, an audible or visual signal is activated to advise the operator at the control panel that somebody needs assistance going through the entrance chamber 12, see block 564. The operator then, using the control panel, will assist the person. The block 563 indicates that the power supply 160 may provide the signal triggered by actuation of the switch 240. The operator may normally release the No. 1 and No. 2 doors if the handicapped person is recognized. If desired, the No. 1 and No. 2 doors (as well as the exit doors) may be powered, if desired, and may be operated by push-bars on the doors, if other conditions are met.

Figure 13A:
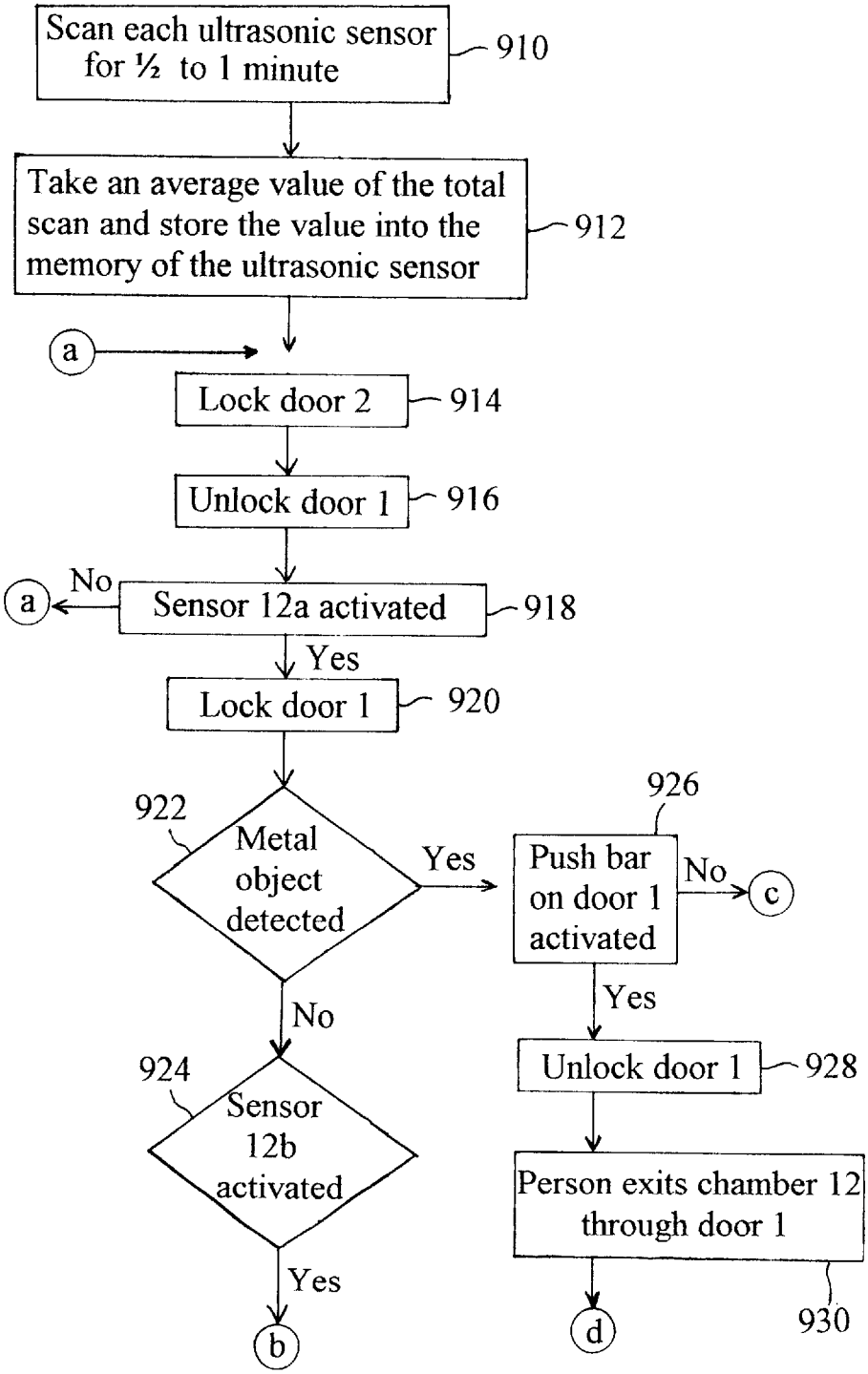
FIG. 13A–C show the flow charts for the operation of the access control system using the ultrasonic transceivers.
Figure 13B:
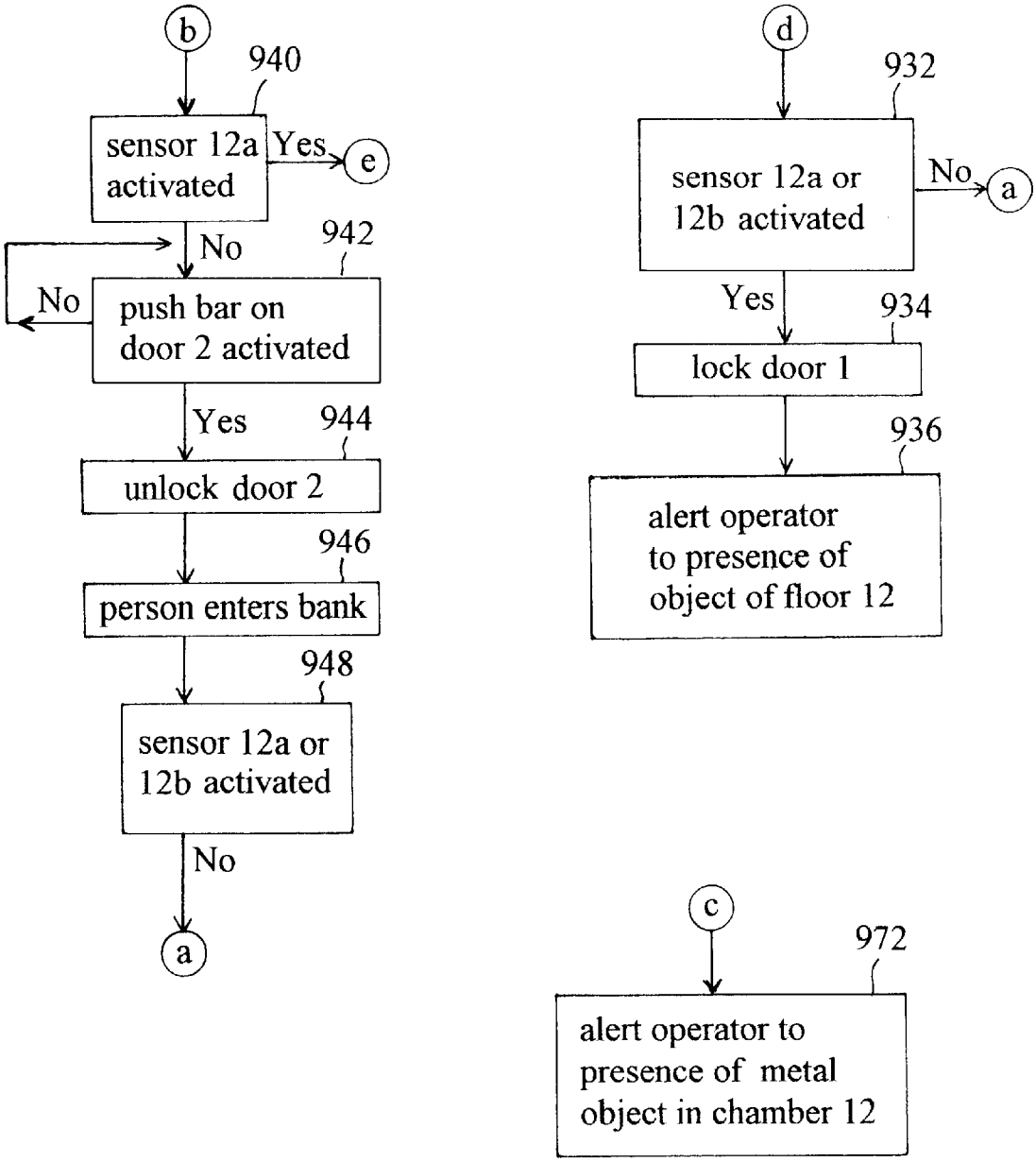
Figure 13C:
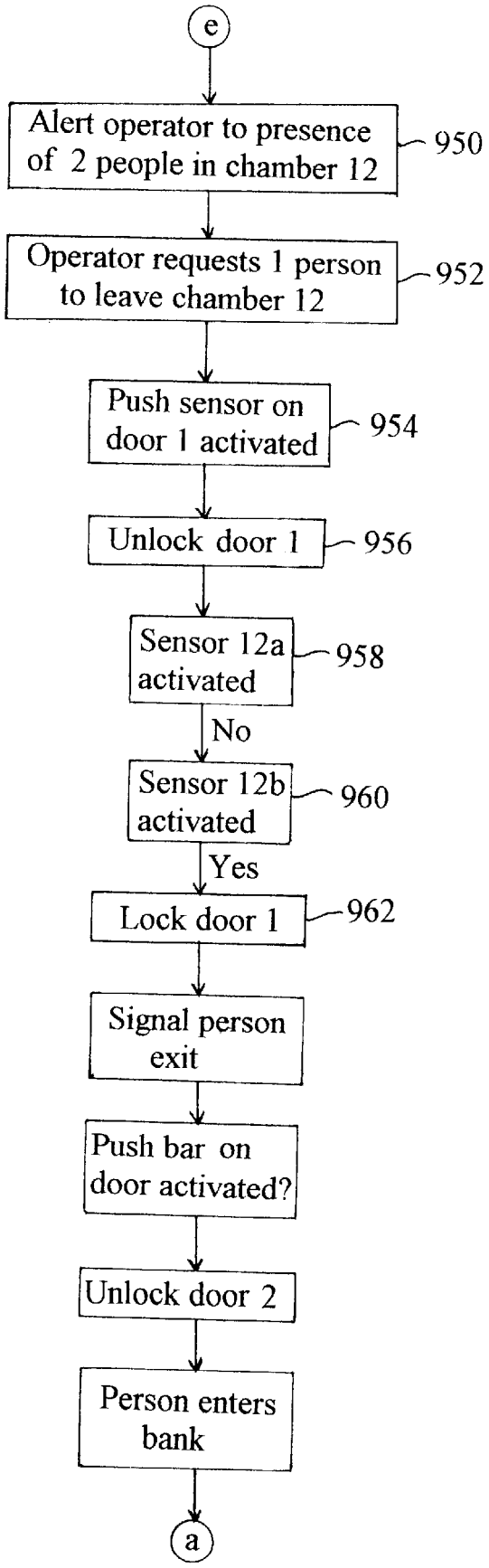
Figure 14A:
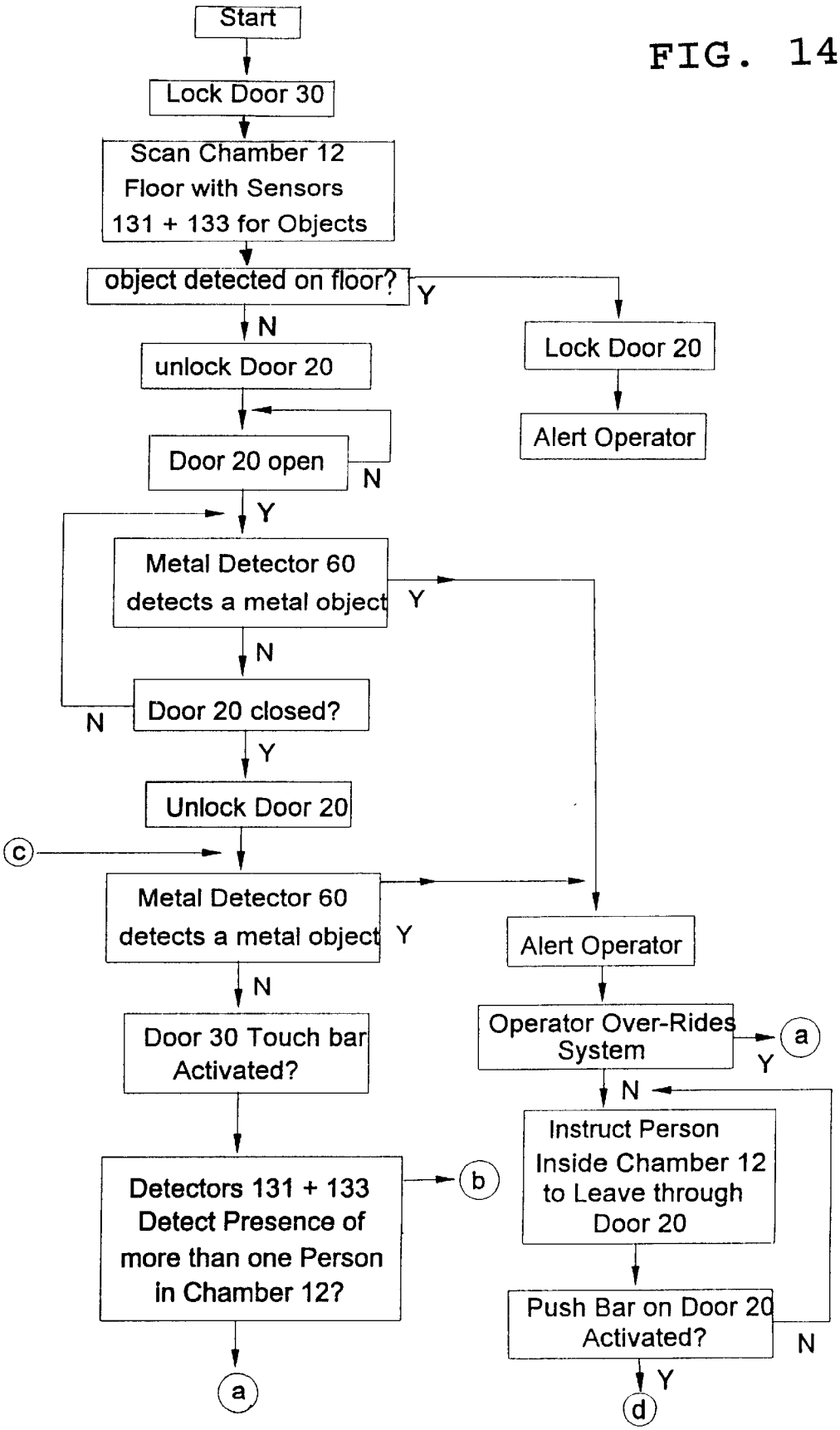
FIGS. 14A through 14E show a flow chart for the operation of the access chamber of the vestibule with a metal detector on continuously.
Figure 14B:
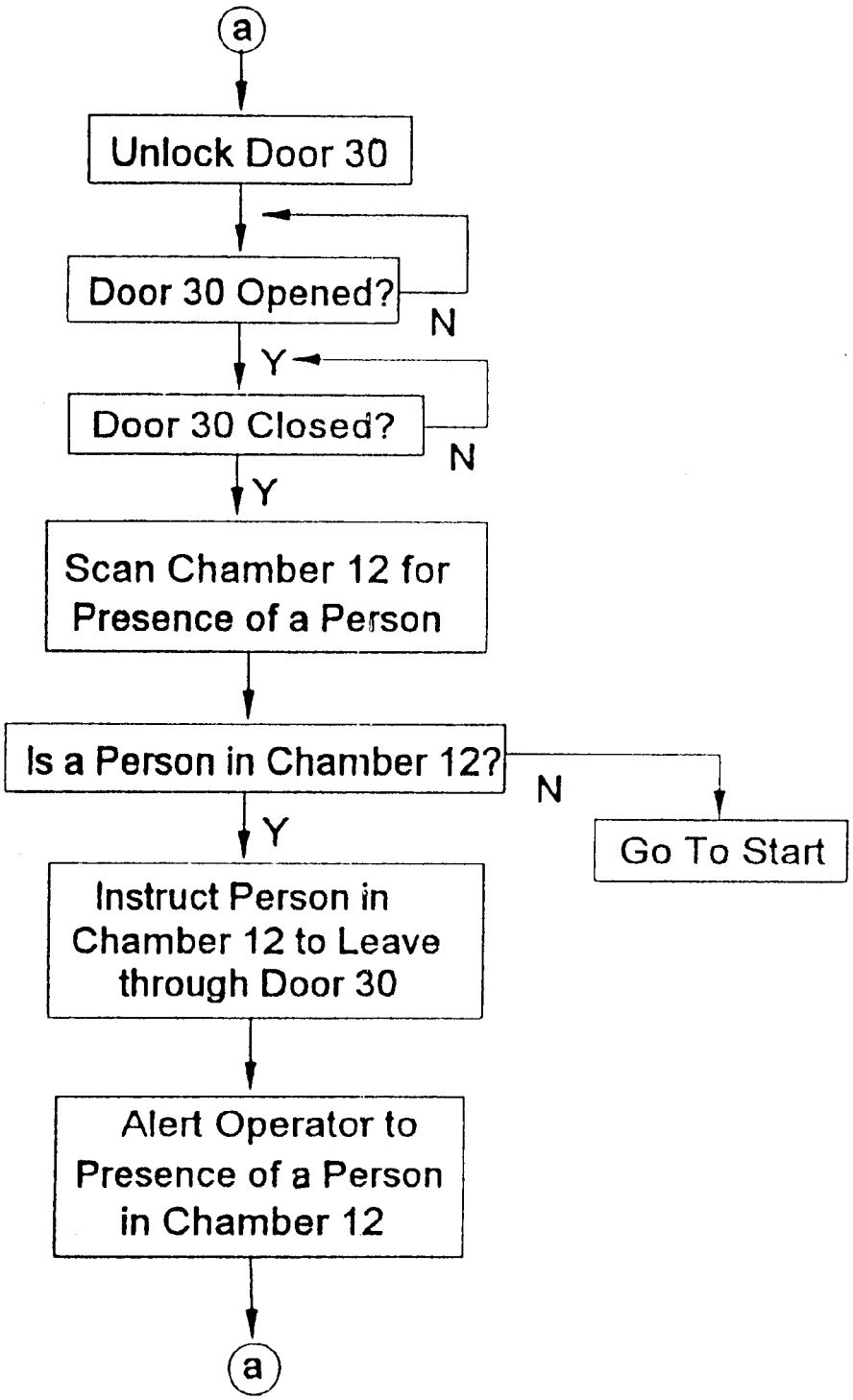
Figure 14C:
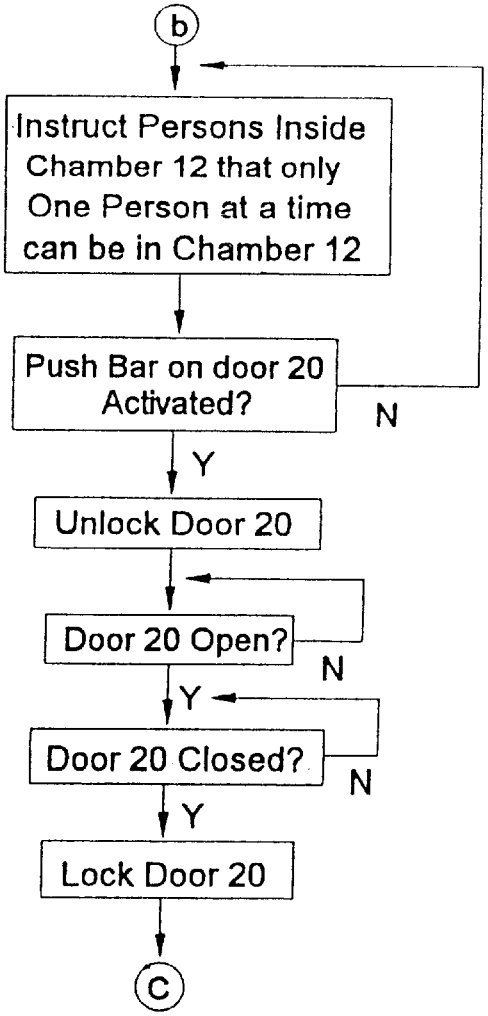
Figure 14D:
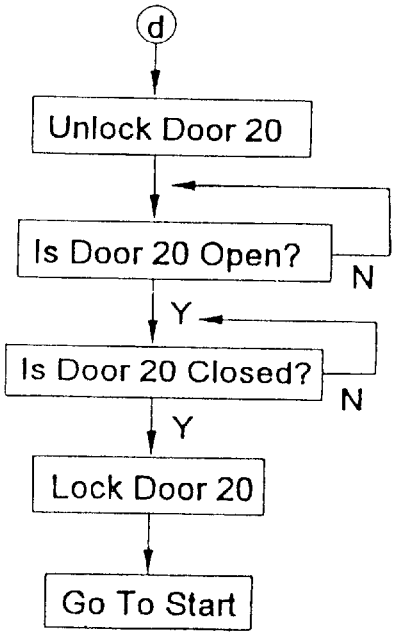
Figure 14E:
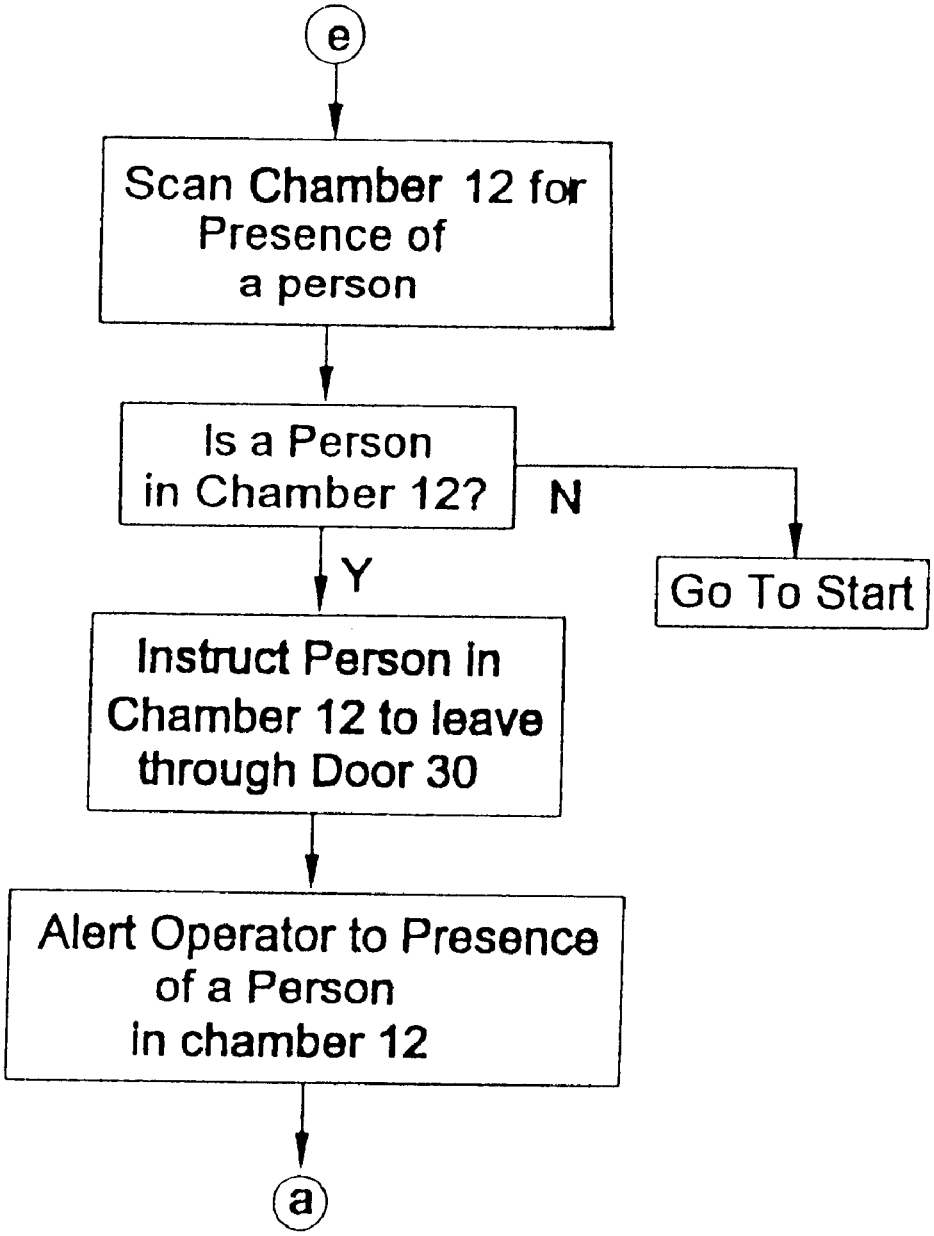
Figure 15A:
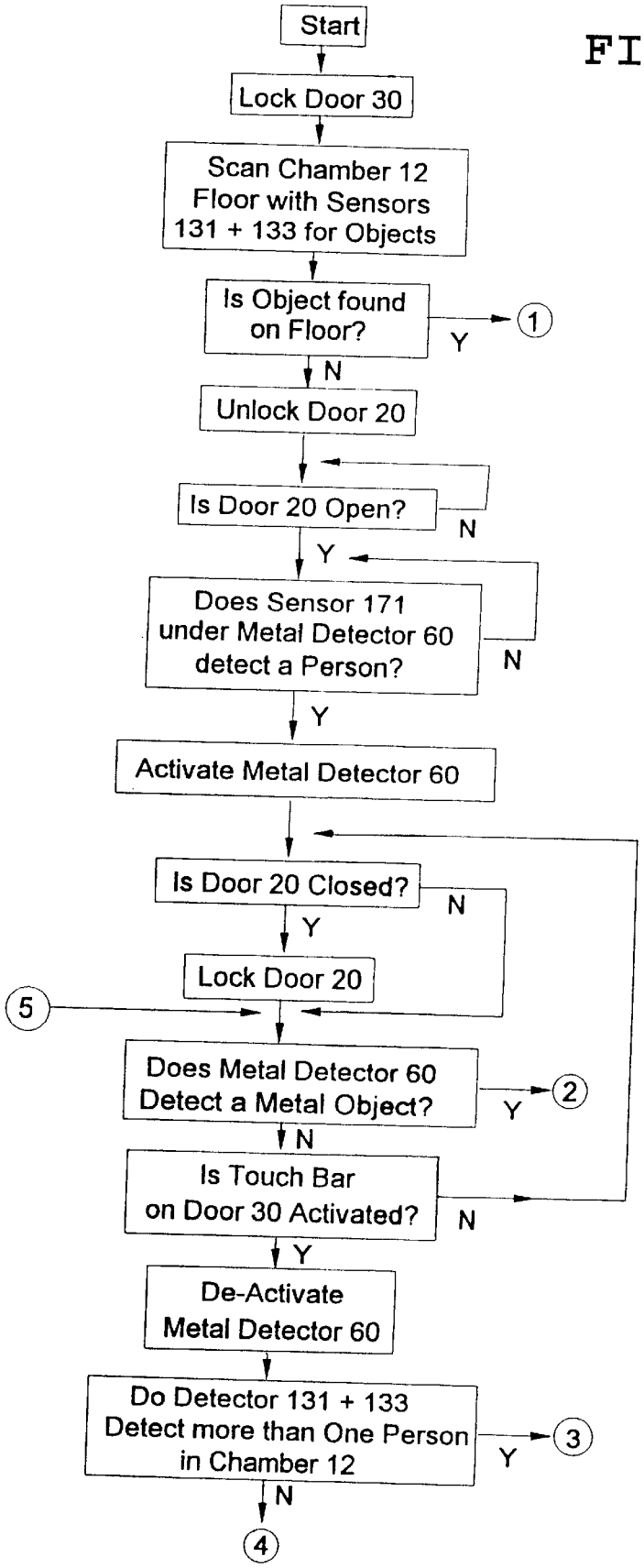
FIGS. 15A through 15E show a flow chart for the operation of the access chamber of the vestibule with a metal detector on intermittently.
Figure 15B:
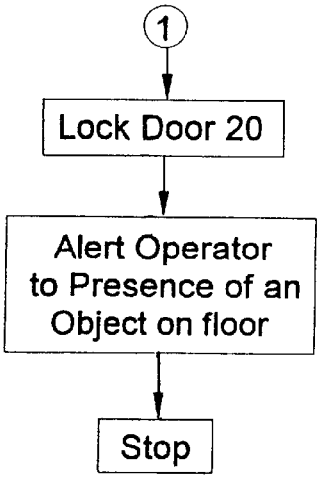
Figure 15C:
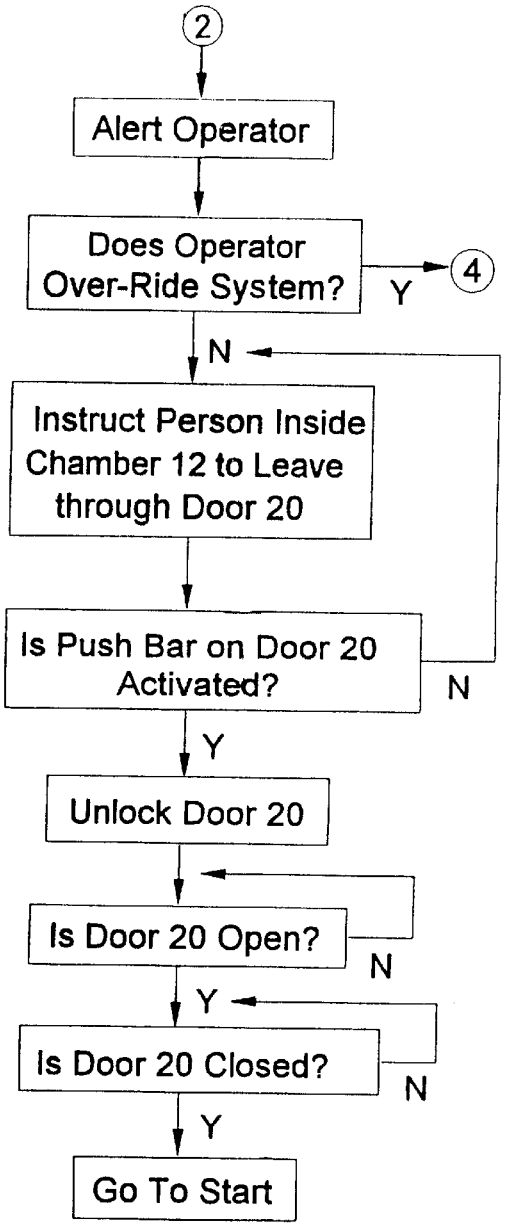
Figure 15D:
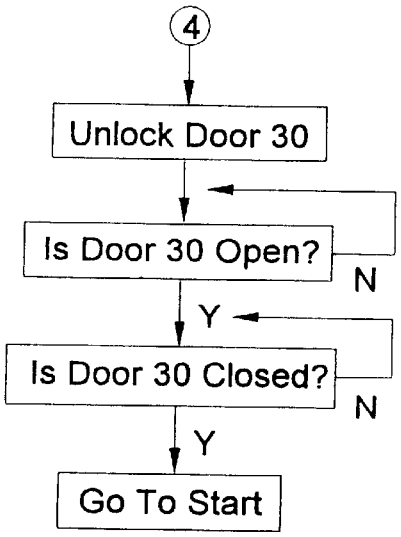
Figure 15E:
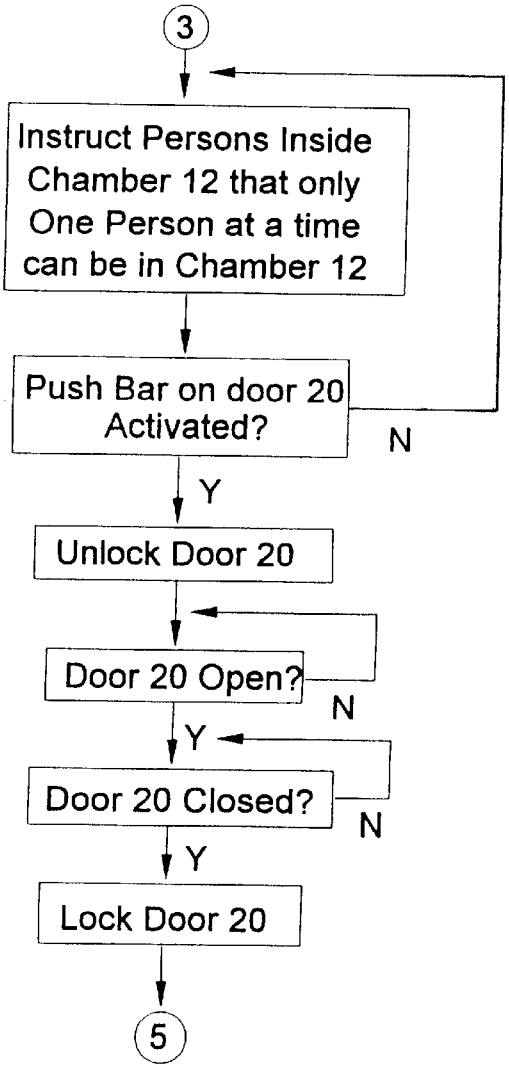

FIG. 13 is a flow chart of the preferred operation of the controls in the entrance chamber of a vestibule using the ultrasonic transceivers. Before the system is placed in operation, each transceiver scans the designated area of the vestibule (step 910) from ½ to 1 minute in duration, and then stores an average value of the scan period into a memory of the sensor (step 912). Once the memory is loaded, the system is ready for operation. The No. 1 door leading into the entrance chamber is unlocked (step 916), while the No. 2 door leading into the secure area (the bank) is locked (step 914). When a person enters the vestibule, he opens the No. 1 door and stands in the in chamber 12*a*. The first ultrasonic transceiver receives an echo from the person positioned on section 12*a* (step 918). Since the echo is different than the signal stored in the memory of an empty chamber section 12*a*, the alarm wire on the sensor goes high. If no person enters the chamber section 12*a*, then the sensor is not activated, and the flow chart returns to step 914. When step 918 is activated, flow passes to step 920 in which the No. 1 door leading into the chamber is locked to prevent another person from entering. Step 922 detects for a metal object within the chamber while a person passes through. If no metal object is detected, flow passes to step 924 in which the ultrasonic sensor above chamber section 12*b* is polled. If the person has passed through the metal detector, then he will be located in section 12*b* of the chamber next to the No. 2 door. If a metal object is detected, then flow passes to step 926 where the system determines if the person carrying a metal object pushes on the No. 1 door in an attempt to leave the vestibule. If the push-bar on the No. 1 door is activated, then step 928 unlocks the No. 1 door in order that the person can exit the chamber through the No. 1 door. If the push bar is not activated then step 972 alerts the operator to the presence of an metal object in the chamber. If the person has exited the chamber, then the ultrasonic sensors above sections 12*a* and 12*b* (step 932) will not be activated, and the flow passes back to the beginning step 914 where the No. 2 door is locked and the No. 1 door is unlocked. If one or both of the sensors are activated (step 932) indicating that a person is still in the chamber or an object such as a weapon has been left on the floor, step 934 then locks the No. 1 door to prevent anyone from the outside of the bank to gain access to the chamber. Step 936 then alerts an operator to check the vestibule. If no metal object is detected in step 922, then flow passes to steps 924 and 940 where the system determines if more than one person is present in the entrance chamber if step 940 is not activated, then step 942 determines if the person has pushed on the No. 2 door in an attempt to gain access into the bank. When this happens, step 944 unlocks the No. 2 door and the person enters the bank (step 946). When sensors above sections 12*a* and 12*b* are not activated, then step 948 determines that the chamber is empty (the person has left the chamber) and flow is passed back to the beginning in step 914. If step 940 determines that more than one person is in the chamber, then step 950 alerts the operator to this event, and the operator through an intercom instructs one of the persons to leave through the No. 1 door (step 952). If one of the person attempts to leave the chamber, push bar on the inside of the No. 1 door is activated (step 954) and the door is unlocked (step 956). Once the person has left the chamber, step 958 determines whether the sensor above section 12*a* is not activated. If the sensor above section 12*b* is still activated, then step 962 locks the No. 1 door. A signal is sent to the person that it is OK to proceed (step 964). When the push bar on the inside of the No. 2 door is activated (step 966), the No. 2 door is unlocked (step 968) and the person enters the bank (step 970). Flow is then returned to the beginning in step 914.

FIGS. 14A through 14E show a flow chart for the operation of the entrance chamber 12 of the vestibule 10 in which the metal detector 60 is on and operating continuously. FIGS. 15*a* through 15*e* show the operation of the entrance chamber 12 in which the metal detector 60 is operated in an intermittent mode. In the intermittent mode, the metal detector is on when a person begins to enter the metal detector area, and off when the second door 30 is about to be opened. If the entrance chamber 12 is long enough, the first door 20 will be closed by the time the person begins entry in the metal detector, and therefore the second door will not produce magnetic interference due to the closed loop effect. If the entrance chamber is not long enough, then the closing speed of the second door 20 can be adjusted such that the door is moving in the latching speed portion (the slow speed just before the door closes) when the person enters the metal detector so that movement of the door is at least in the slow range to produce minimal interference with the metal detector.

The program steps or modes of operation are set forth in FIGS. 8A through 8J are implemented by the microprocessor 400 of FIG. 7 under the control of the Read Only Memory, or ROM 410 by which the program steps are implemented. By way of example only, and not by way of limitations, the following companies may supply appropriate parts of the present invention. Securitron Magnalock Corp (650 Vista Blvd., Sparks, Nev. 89434) produces a preferred embodiment of a Power Supply (3 amp., BPS -24-3), Magnetic Lock (1,200 pds, M62S-24), Magnetic Lock (800 and, M32S-24), Touch Sense Bars (TSB-1), Control Panel (LCP-8-42), Second Operator Button (PB2, Nova, Custom Deck), and ADA Assistance Push Button (PB-2). EG&G Astrophysics Research Corporation, Long Beach, Calif., produces a preferred embodiment of the Metal Detector Electronic Components (01-0206-01/Sentries AT Telem Kit). Another metal detector is that made by the Metorex company, model number metor 160. Viracon of Owatonna, Minn. produces preferred embodiments of Bullet Resistant Glass Level 1 (Guard Vue 100) and Bullet Resistant Glass Level 2 (Guard Vue 300). L.C.N. Closers of Princeton IL produces preferred embodiments of Left Hand Concealed Door Closer (2033 Closer CYL-SR1 LH) and Right Hand Concealed Door Closer (2033 Closer CYL-SRT RH). Optex (U.S.), Inc. of Torrance, Calif., produces a preferred embodiment of a Photocell Safety Beam Switch (OS-2C). These parts are meant to be exemplary and are not intended to limit the scope of the invention.

In conclusion, it is to be understood that the present invention is not to be limited to that precisely as described herein and as shown in the accompanying drawings. More specifically, the invention could be adapted to provide security for any secure area such as a bank vault, jewelry store, prison, or other security buildings. Additional handles and push bars could be added or the manual pull handle may be replaced with an electrically activated automatic system for opening the doors when access or egress is permitted. It is further noted that the functions as shown in FIGS. 8A through 8J may readily be implemented using hand wired relay or transistor circuits instead of the microprocessor implementation described herein. Also, instead of floor contact pads, other detection arrangements may be provided to determine the location of persons within the entrance and exit chambers. Further, the entrance chamber as disclosed herein may be employed to control access to the secured area, and other exit-only arrangements may be provided, for example, of the general type used in subway exits using a one-way revolving door type assembly having interlocking bars to prevent entry. Accordingly, the present invention is not limited to the arrangements precisely as shown and described herein.

I claim:

1. An access control vestibule, comprising;

a vestibule frame configured to form said access control vestibule mounted in said vestibule frame;

an entrance door and an exit door;

an entrance door frame and an exit door frame;

a panel mounted in said vestibule frame and forming a side wall section of said vestibule;

said entrance door and said exit door being formed by a panel mounted in each of said door frames;

locks associated with said entrance door and said exit door;

a metal detector located to detect a metal object being disposed between said entrance and exit doors;

control means to prevent both doors from being unlocked at the same time, and to prevent said exit door from being unlocked when said metal detector detects a metal object;

said entrance door and said exit door both being manually operated; and said entrance door and said exit door each being formed by a single swinging door, and swingable towards the outside of said vestibule.

2. The access control vestibule of claim 1, and further comprising;

a 24 volt DC power supply to supply power to the control means; and the control means including means to maintain power to the metal detector when said vestibule is shut off.

3. The access control vestibule of claim 1, and further comprising;

a 24 volt DC power supply to supply power to the control means; and said metal detector operating at 24 volts DC.

4. The access control vestibule of claim 1, and further comprising;

said control means including a 24 volt DC battery backup.

5. The access control vestibule of claim 1, further comprising:

a floor and an ultrasonic sensor; and said ultrasonic sensor located to detect presence of a person above said floor of said vestibule.

6. The access control vestibule of claim 1, and further comprising;

means to detect an object on a floor of said vestibule.

7. The access control vestibule of claim 1, and further comprising;

means to detect a person straddling a floor of said vestibule.

8. The access control vestibule of claim 1, wherein the entrance door and the exit door form an entrance chamber;

a secured area is formed in the interior of said vestibule;

a second entrance door and a second exit door form an exit chamber;

said exit chamber is arranged alongside said entrance chamber; and said control means prevents said second entrance door of said exit chamber from being opened upon said second exit door of said exit chamber being unlocked;

thus said entrance chamber is configured to allow entrance into said secured area, and said exit chamber is configured to allow exit from said secured area.

9. The access control vestibule of claim 8, and further comprising;

said second exit door of said exit chamber being configured to swing towards the outside of said exit chamber.

10. The access control vestibule according to claim 9, wherein said metal detector in said vestibule is located closer to the exit door than to the entrance door such that a magnetic field generated by the entrance door frame does not affect the operation of said metal detector.

11. The access control vestibule according to claim 5, wherein:

said ultrasonic sensor disposed above said floor of said vestibule is used to detect the presence of a person in said vestibule or an object on said floor of said vestibule; and said ultrasonic sensor is located above said metal detector.

12. The access control vestibule according to claim 11, further comprising:

a touch-sense pad located on an inside of the exit side of said vestibule;

said control means to disable said metal detector when said touch-sensitive pad is touched;

a first ultrasonic sensor located above the entrance side of said metal detector of said vestibule;

a second ultrasonic sensor located above the exit side of the metal detector of said vestibule;

said control means to detect if both said first and second ultrasonic sensors detect the presence of an object or a person at the same time.

13. A method of controlling access through a double-door system, the method comprising the steps of:

providing a first lockable door;

providing a second lockable door;

providing an enclosed chamber between said two doors;

providing a metal detector located to detect a metal object being disposed between said two doors;

providing means to detect a presence of a person within said enclosed chamber;

providing means to detect when a person touches said second door;

unlocking said first door;

locking said second door;

locking said first door when the means to detect a presence of a person detects the presence of a person within the chamber;

determining if said metal detector has detected a metal object;

unlocking said second door when said metal detector has not detected a metal object and when the means to detect when the person touches the second door detects that the person touches the second door;

enabling said metal detector when the presence of a person is detected and said first door is locked; and disabling said metal detector when said means to detect detects a person touching said second door.

14. An access control vestibule, comprising;

a vestibule frame having a rectangular shape configured to form an access control vestibule mounted in said vestibule frame;

an entrance door frame and an exit door frame;

a panel mounted in said vestibule frame and forming a side wall section of said vestibule;

a panel mounted in each of the door frames and forming an entrance door and an exit door;

said entrance door and said exit door both being manually operated, each formed of a single swinging door, and each swingable towards the outside of said vestibule;

a lock associated with each of the doors;

a metal detector located to detect a metal object being disposed between said entrance and exit doors; and control means to prevent both doors from being unlocked at the same time when said metal detector detects a metal object.

* * * * *

UNITED STATES PATENT AND TRADEMARK OFFICE

CERTIFICATE OF CORRECTION

PATENT NO. : 6,308,644 B1
DATED : October 30, 2001
INVENTOR(S) : William Diaz

It is certified that error appears in the above-identified patent and that said Letters Patent is hereby corrected as shown below:

Column 1,
Line 15, after "which" delete "in".

Column 8,
Line 42, after the second occurrence of "the" delete "is".

Column 15,
Line 29, before "technology.", delete "Know" and insert -- known --.

Column 18,
Line 16, before "8C", delete "FIG." and insert -- FIGS. --.

Column 19,
Line 38, after "electromagnetic", delete "Jocks" and insert -- locks --.

Column 20,
Line 50, after the first occurrence of "the" delete "in".

Column 21,
Line 66, after "Corp", delete "(650" and insert -- (550 --.

Signed and Sealed this

Fifth Day of November, 2002

*Attest:*

*Attesting Officer*

JAMES E. ROGAN
*Director of the United States Patent and Trademark Office*